US009347183B2

(12) United States Patent
Pielli

(10) Patent No.: US 9,347,183 B2
(45) Date of Patent: May 24, 2016

(54) TIE EXTENSION BRACKET

(71) Applicant: NATIONAL RAILROAD PASSENGER CORPORATION, Washington, DC (US)

(72) Inventor: John A. Pielli, Jackson, NJ (US)

(73) Assignee: NATIONAL RAILROAD PASSENGER CORPORATION, Washington, DC (US)

( * ) Notice: Subject to any disclaimer, the term of this patent is extended or adjusted under 35 U.S.C. 154(b) by 254 days.

(21) Appl. No.: 13/895,407

(22) Filed: May 16, 2013

(65) Prior Publication Data

US 2014/0339319 A1 Nov. 20, 2014

(51) Int. Cl.
*E01B 3/00* (2006.01)
*E01B 26/00* (2006.01)

(52) U.S. Cl.
CPC .. *E01B 3/00* (2013.01); *E01B 26/00* (2013.01)

(58) Field of Classification Search
CPC ..... E01B 3/00; E01B 3/18; E01B 3/26
See application file for complete search history.

(56) References Cited

U.S. PATENT DOCUMENTS

| | | | | | |
|---|---|---|---|---|---|
| 707,257 | A * | 8/1902 | Reed | 238/39 |
| 711,305 | A * | 10/1902 | Gibboney | 238/39 |
| 1,068,700 | A * | 7/1913 | Ramsay | 238/99 |
| 1,090,482 | A * | 3/1914 | Laudermilch | 238/99 |
| 1,110,902 | A * | 9/1914 | Cowen | 238/56 |
| 1,227,083 | A * | 5/1917 | Snyder | 238/99 |
| 1,441,954 | A * | 1/1923 | Varner | 238/99 |
| 1,541,688 | A * | 6/1925 | Cox | 238/39 |
| 1,663,984 | A * | 3/1928 | Haskell | 238/58 |
| 1,751,156 | A * | 3/1930 | Hewitt | 238/96 |
| 1,776,422 | A * | 9/1930 | Empey | 238/77 |
| 2,651,714 | A * | 9/1953 | Poole | 246/253 |
| 3,621,237 | A * | 11/1971 | Hylen | 246/31 |
| 4,098,374 | A * | 7/1978 | Frank | 188/62 |
| 7,267,304 | B2 * | 9/2007 | Scheer | 246/410 |
| 7,530,535 | B2 * | 5/2009 | Fox | 246/452 |
| 2004/0227037 | A1 * | 11/2004 | Schwiede et al. | 246/415 R |
| 2014/0339319 | A1 * | 11/2014 | Pielli | 238/30 |

* cited by examiner

*Primary Examiner* — Jason C Smith
(74) *Attorney, Agent, or Firm* — Hauptman Ham, LLP

(57) ABSTRACT

A tie extension bracket comprises a rectangular-shaped box having at least three sides. Two of the sides being arranged parallel to each other and the remaining side being a connecting support plate connecting the two parallel sides to each other. The two parallel sides extending beyond the connecting support plate to form a U-shaped portion dimensioned to receive at least an end portion of a railroad tie therein.

25 Claims, 34 Drawing Sheets

TIE EXTENSION BRACKET

BACKGROUND

Rails for railroad tracks or guideways are seated atop supports known as railroad ties. In some instances, railroad ties are wooden. In other instances, metal or concrete ties (also referred to as sleepers) are used for the support. Vehicles such as trains traversing the rails induces vibrations in the railroad ties. As such, devices connected to the railroad ties may be subjected to such vibrations.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
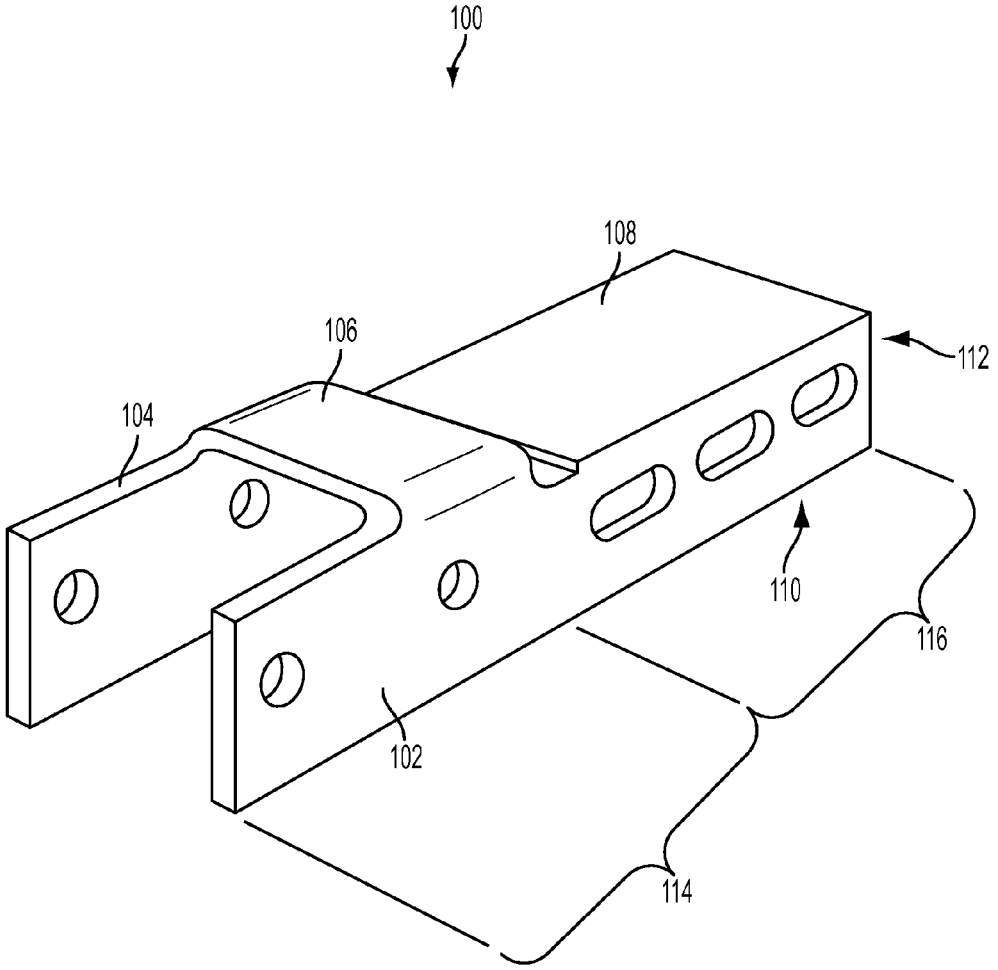
FIG. 1 is a perspective view of a tie extension bracket according to an embodiment.

FIG. 1 is a perspective view of a tie extension bracket 100 according to an embodiment. Tie extension bracket 100 comprises a rectangular-shaped box having at least three sides. At least two of the sides 102, 104 are arranged parallel to each other and the remaining side is a connecting support plate 108 connecting the two parallel sides to each other. The two parallel sides 102, 104 have a length which extends beyond a length of connecting support plate 108 to form a U-shaped portion dimensioned to receive at least an end portion of a railroad tie therein. In at least some embodiments, bracket 100 has a trapezoid shaped cross-section. In at least some other embodiments, bracket 100 is rectangular shaped in cross-section.

The U-shaped portion is sized to fit a railroad tie support for a railway rail. In at least some embodiments, the U-shaped portion is from 7 to 12 inches in width. In at least some embodiments, the U-shaped portion is from 10 to 11 inches in width. In at least some embodiments, the U-shaped portion is from 6 to 12 inches in height. In at least some embodiments, the U-shaped portion is from 9 to 11 inches in height. In at least some embodiments, the U-shaped portion is from 12 to 24 inches in depth. In at least some embodiments, the U-shaped portion is from 11 to 19 inches in depth. In at least some embodiments, the U-shaped portion comprises fifty percent of the length of bracket 100. In at least some embodiments, the U-shaped portion comprises less than fifty percent of the length of bracket 100.

Tie extension bracket 100 is made of metal or other suitable material. In at least some embodiments, one or more portions of bracket 100 are made of metal or other suitable material.

Side 102 has the same shape and configuration as parallel side 104. In at least some embodiments, side 102 differs in shape and/or configuration from parallel side 104.

Connecting support plate 108 is a rectangular-shaped piece which connects sides 102, 104. In at least some embodiments, connecting support plate 108 is welded along a lengthwise edge of the support plate to the corresponding side 102, 104. In at least some embodiments, connecting support plate 108 has one or more pre-drilled through-holes in the surface in order to enable connection of devices to bracket 100. In at least some embodiments, connecting support plate 108 has no through-holes in the surface. In at least some embodiments, connecting support plate 108 comprises a stacked combination of identical size and shape plates.

In at least one embodiment, connecting support plate 108 is welded to an isolation pad which is bonded to each of the parallel sides 102, 104 as described above in place of connecting support plate 108. Thus, in the given embodiment, the isolation pad is connected to sides 102, 104 in place of connecting support plate 108. In this manner, isolation pad is similar size, shape, and/or configuration as connecting support plate 108. In at least some embodiments, the isolation pad is, for example, Fabreeka SA47 type material available from Fabreeka International of Massachusetts. In at least some embodiments, the isolation pad is another suitable material for isolating a device connected to connecting support plate 108 from vibration transmitted through bracket 100.

Parallel sides 102, 104 each have at least two portions: a tie extension portion 114 and a support portion 116. Tie extension portion 114 corresponds to a portion of the side which extends beyond connecting support plate 108 and support portion 116 corresponds to at least a portion of the length of the side at which connecting support plate 108 connects.

Support portion 116 has a height which is less than a height of the tie extension portion 114. In at least some embodiments, tie extension portion 114 is taller than support portion 116. In still further embodiments, the height of support portion 116 is the same as the height of tie extension portion 114.

Support portion 116 has a length which is greater than a length of tie extension portion 114. In at least some embodiments, tie extension portion 114 is longer than support portion 116. In still further embodiments, the length of support portion 116 is the same as the length of time extension portion 114.

Each of the parallel sides 102, 104 has two through-holes formed in the tie extension portion 114. The through-holes formed in one of the parallel sides are aligned with the corresponding through holes in the other parallel side. In at least some embodiments, the formed through-holes are used in conjunction with an anchoring device, e.g., an anchor rod or other suitable arrangement, to anchor the extension bracket 100 to a railroad tie received in the tie extension portion 114.

In at least some embodiments, each of the parallel sides 102, 104 has at least one through-hole formed in the tie extension portion 114. In at least some other embodiments, each of the parallel sides 102, 104 has more than two through-holes formed in the tie extension portion 114. In at least one embodiment in which parallel sides 102, 104 differ in shape and/or configuration, at least one through-hole formed in each of the sides is aligned with at least one through-hole formed in the other of the sides.

In at least some embodiments, the through-holes formed in tie extension portion 114 are each circular. In at least some embodiments, the through-holes formed in tie extension portion 114 are other than circular. In at least some embodiments, the circular through-holes formed in tie extension portion 114 are 2 inches in diameter.

Each of the parallel sides 102, 104 has three through-holes formed in the support portion 116. The through-holes formed in one of the parallel sides are aligned with corresponding through-holes in the other parallel side. In at least some embodiments, the parallel sides 102, 104 omit the three through-holes. At least some other embodiments, the parallel sides 102, 104 have greater or fewer number of through-holes formed in the support portion 116.

In at least some embodiments, the through-holes formed in support portion 116 of the parallel sides 102, 104 are sized to enable a tool to pass through the opening to the interior of bracket 100 in order to tighten and/or connect a device on connecting support plate 108. In a given embodiment, the through-hole is sized to allow a user to insert a wrench therethrough in order to tighten or assist in tightening a nut to secure the mounting of a device on connecting support plate 108. In at least some other embodiments, the through-holes formed in support portion 116 are sized to enable a person's hand to pass through the opening to the interior of bracket 100.

In at least some embodiments, the through-holes formed in the support portion 116 are each rounded rectangular shapes. In at least some embodiments, the through-holes formed in support portion 116 are each rectangular shaped. In at least some embodiments, the through-holes formed in support portion 116 have a shape other than rectangular. In at least some embodiments, the through-holes formed in support portion 116 are 5 to 7 inches in length and in some embodiments, 6 inches in length.

In at least some embodiments, the through-holes formed in tie extension portion 114 and support portion 116 are formed such that the centers of the through-holes are at the same height above the bottom of the side.

In at least some embodiments, each of parallel sides 102, 104 is three-quarter inch in thickness. In at least some embodiments, each of parallel sides 102, 104 is 51 inches in length. In at least some embodiments, support portion 116 is seven and three-quarter (7¾) inches in height. In at least some embodiments, each of parallel sides 102, 104 is 10 inches in height at a highest portion of the side.

Tie extension bracket 100 also comprises a top connecting plate 106 connecting an upper edge of side 102 to side 104, similar to connecting support plate 108. Top connecting plate 106 is perpendicular to sides 102, 104 and connected to the sides at a second portion of the upper edge of each of the sides. Top connecting plate 106 is rectangular-shaped. In at least some embodiments, top connecting plate 106 has a different shape and/or configuration. In at least some embodiments, top connecting plate 106 is connected to sides 102, 104 at the highest portion of the sides. In at least some embodiments, top connecting plate 106 is connected to sides 102, 104 at a height greater than the height at which connecting support plate 108 connects to the sides. In at least some embodiments, top connecting plate 106 is parallel to connecting support plate 108.

Top connecting plate 106 effectively bridges from side 102 to side 104. In at least one embodiment, top connecting plate 106 is omitted. Top connecting plate 106 has an outer surface and an inner surface. In at least some embodiments, the inner surface of top connecting plate 106 faces a railroad tie inserted into tie extension portion 114.

In at least some embodiments, top connecting plate 106 is connected to sides 102, 104 along the entire length of the tie extension portion 114 of the sides. In at least some embodiments, top connecting plate 106 is connected to a portion of the tie extension portion 114 edge of the sides.

In at least some embodiments, top connecting plate 106 is ½ inch in thickness. In at least some embodiments, top connecting plate 106 is 8 inches in length in a direction extending parallel to side 102. In at least some embodiments, top connecting plate 106 is 11 inches in width in a direction extending perpendicular to side 102.

Tie extension bracket 100 also comprises a rear connecting plate 112 connecting a rear edge of side 102 side 104. Rear connecting plate 112 is arranged perpendicular to connecting support plate 108 and parallel sides 102, 104. Rear connecting played 112 is rectangular-shaped.

In at least some embodiments, the rear connecting plate 112 has a different shape and/or configuration. In at least some embodiments, rear connecting plate 112 is arranged perpendicular to connecting support plate 108. In at least some embodiments, rear connecting plate 112 is arranged perpendicular to parallel sides 102, 104. In at least some embodiments, where connecting plate 112 is positioned such that an inner surface of the rear connecting plate faces an end surface of a received end portion of a railroad tie.

Rear connecting plate 112 has a through-hole formed in the face thereof. The through-hole formed in the face is sized to enable a tool to pass through the opening similar to the through-holes formed in support portion 116 of parallel sides 102, 104. In at least some embodiments, rear connecting plate 112 has no through-holes formed therein. In at least some other embodiments, the through-hole formed in rear connecting plate 112 is sized to enable a person's hand to pass through the opening to the interior of bracket 100.

In at least some embodiments, rear connecting plate 112 has a greater number of through-holes formed therein. In at least some embodiments, the through-hole formed in rear connecting plate 112 is a rounded rectangular shape. In at least some embodiments, the through-hole formed in rear connecting plate 112 has a different shape. In at least some embodiments, the through-hole formed in rear connecting plate 112 is between 6 and 8 inches in width.

In at least some embodiments, rear connecting plate 112 is ¼ inch in thickness. In at least some embodiments, rear connecting plate 112 is trapezoidal in shape, tapering from the top to the bottom.

Tie extension bracket 100 also comprises a bottom plate 110 connecting parallel sides 102, 104 at a lower edge thereof. Bottom plate 110 has the same shape and/or configuration as connecting support plate 108. In at least some embodiments, bottom plate 110 extends along substantially the entire portion of support portion 116. In at least some embodiments, bottom plate 110 comprises one or more connecting strips arranged in parallel and in the same plane and connecting side 102 to side 104. In at least some embodiments, bottom plate 110 is parallel with connecting support plate 108.

In at least some embodiments, bottom plate 110 is ¼ inch in thickness. In at least some embodiments, the bottom of bracket 100 is cross braced.

Figure 2:
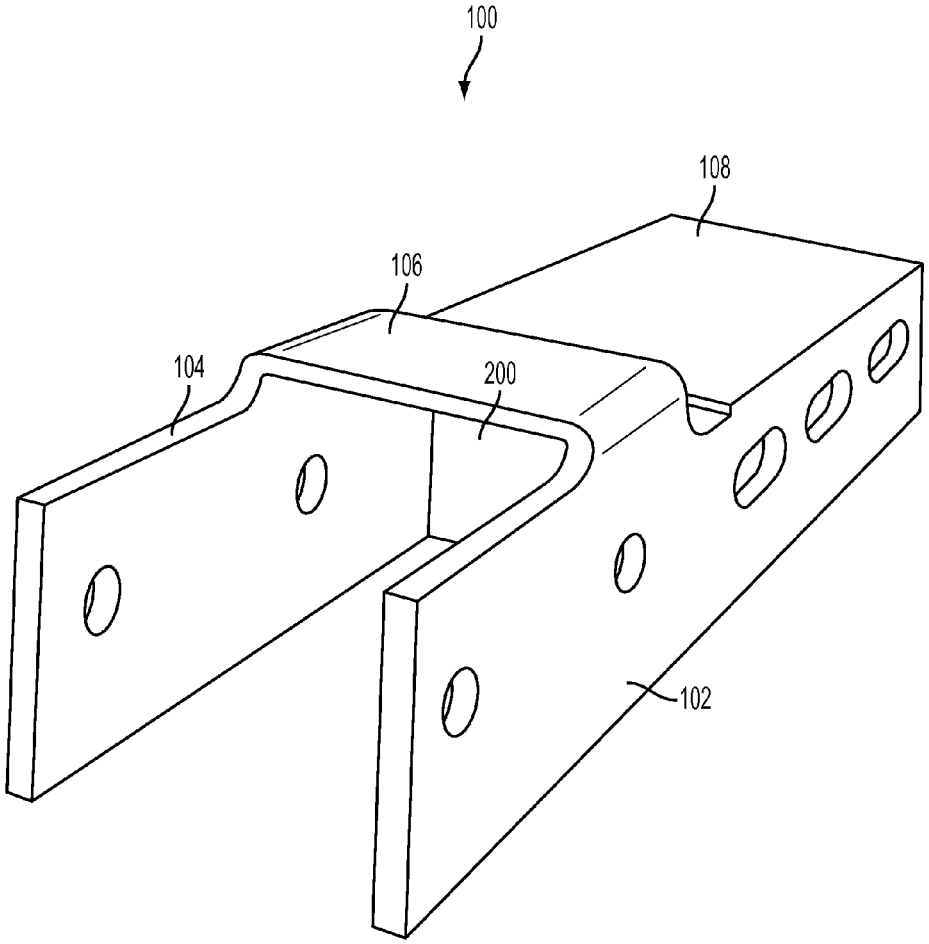
FIG. 2 is another perspective view of the bracket according to another embodiment

FIG. 2 is another perspective view of the bracket 100 according to an embodiment. In at least some embodiments, bracket 100 further comprises an end plate 200 perpendicular to sides 102, 104 and connecting support plate 108 and parallel to rear connecting plate 112. End plate 200, in combination with sides 102, 104, rear connecting plate 112, and bottom plate 110 comprises the fourth side of a rectangular-shaped box forming the support portion of bracket 100. In at least some embodiments, end plate 200 is of similar size and shape as rear connecting plate 112. In at least some embodiments, end plate 200 has no through-holes formed therein.

Figure 3:
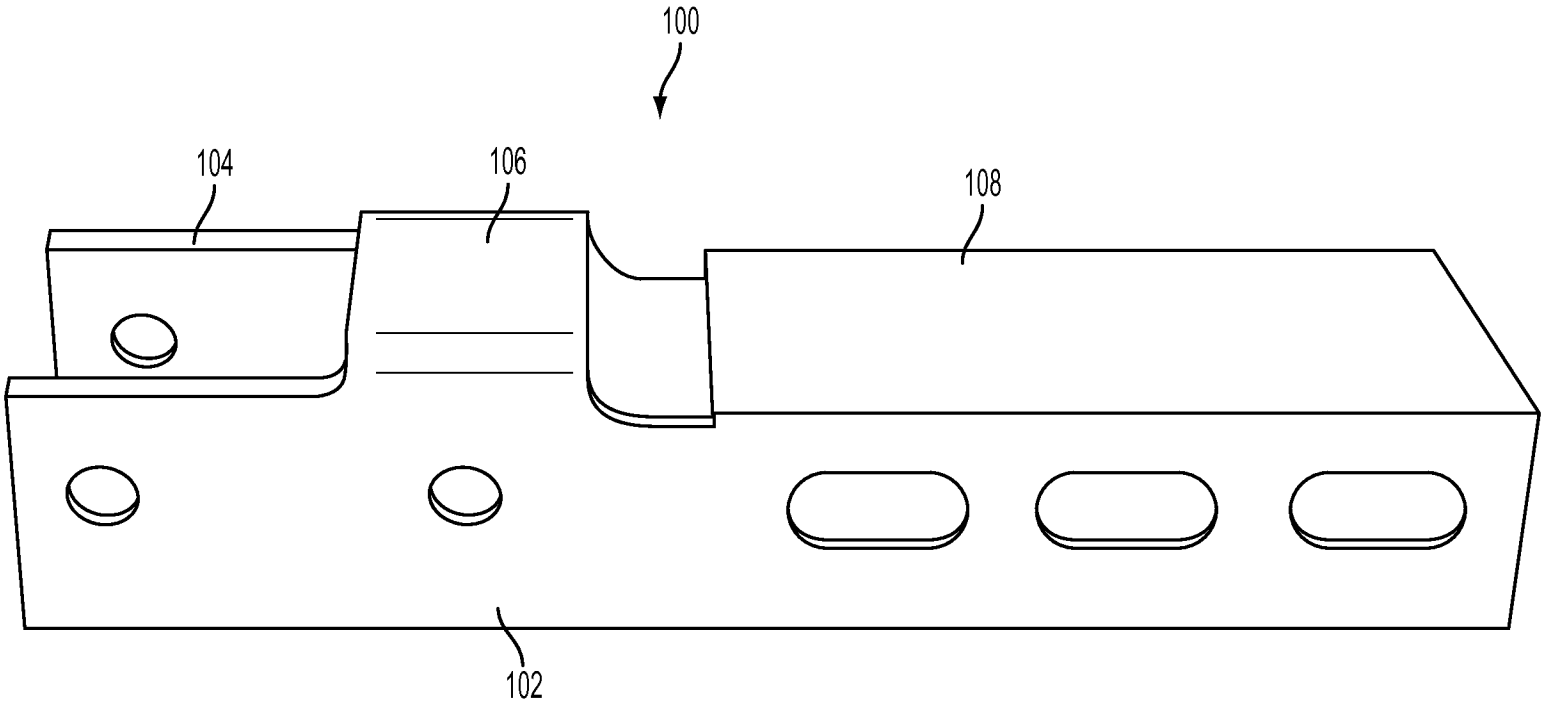
FIG. 3 is a side perspective view of the bracket according to an embodiment.

FIG. 3 is a side perspective view of the bracket 100 according to an embodiment.

Figure 4:
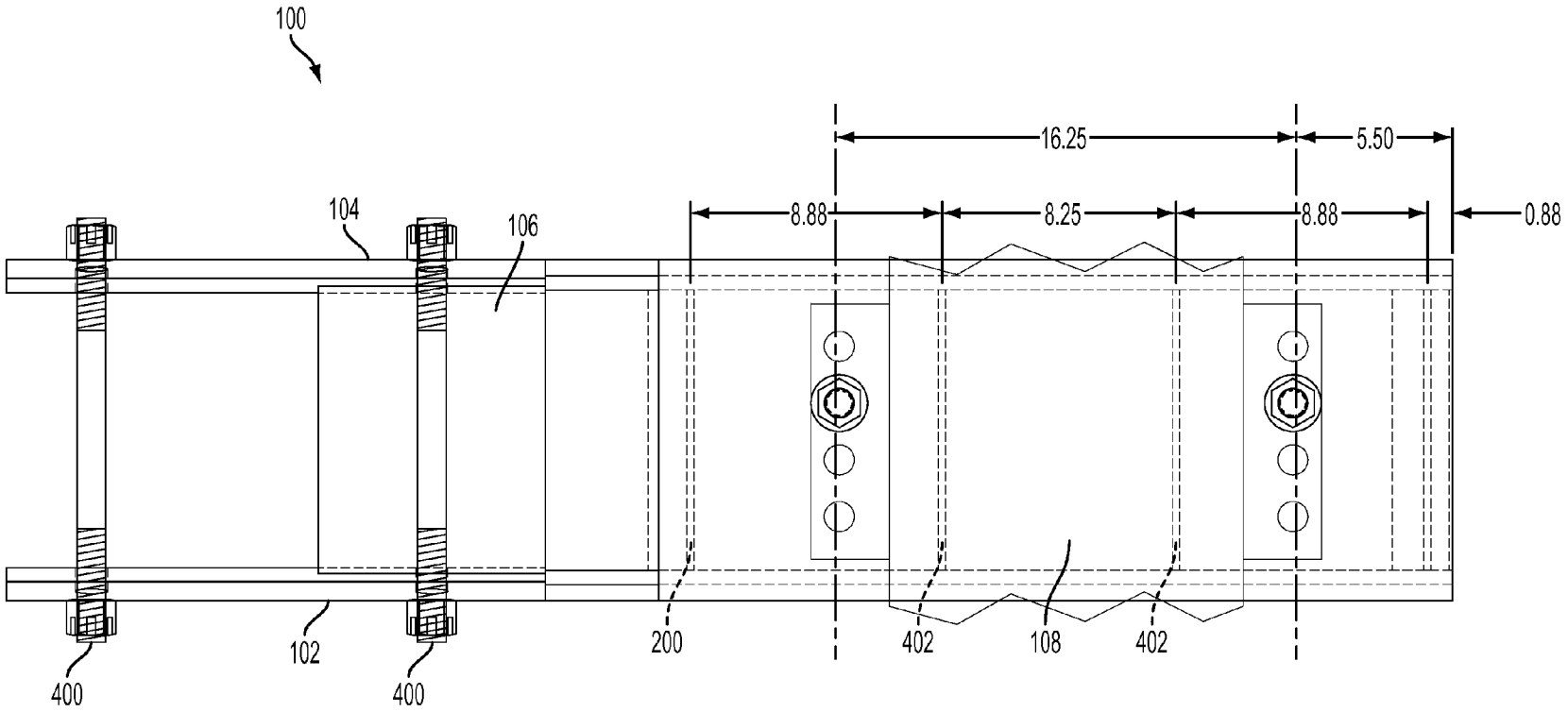
FIG. 4 is a top plan view of the bracket according to an embodiment.

FIG. 4 is a top plan view of the bracket 100 according to an embodiment. As depicted, a pair of anchor rods 400 are inserted in through-holes in tie extension portion 114 of sides 102, 104. Anchor rod 400 is sized to span the formed U-shaped portion. Anchor rod 400 is threaded at each end for receiving a retaining nut threaded onto each end at an outer face of a corresponding side 102, 104. In at least some embodiments, anchor rod 400 is threaded at one end. In at least some embodiments, anchor rod 400 is not threaded and another suitable mechanism for retaining the received railroad tie is used. In at least some embodiments, anchor rod 400 is arranged to extend beyond the side of the parallel sides 102, 104 when inserted in each of the at least one through-holes and spanning the formed U-shaped portion.

Also as depicted, a pair of internal plates 402 are depicted as spanning from side 102 to side 104. Each internal plate 402 is similar shape, size and configuration as end plate 200. In at least some embodiments, each internal plate 402 is a different shape, size, and configuration from end plate 200 suitable for providing the support to the bracket 100. Internal plate 402 extends parallel to end plate 200 and perpendicular to connecting support plate 108 and sides 102, 104. In at least some embodiments, internal plates 402 are evenly spaced between end plate 200 and rear connecting plate 112.

Figure 5:
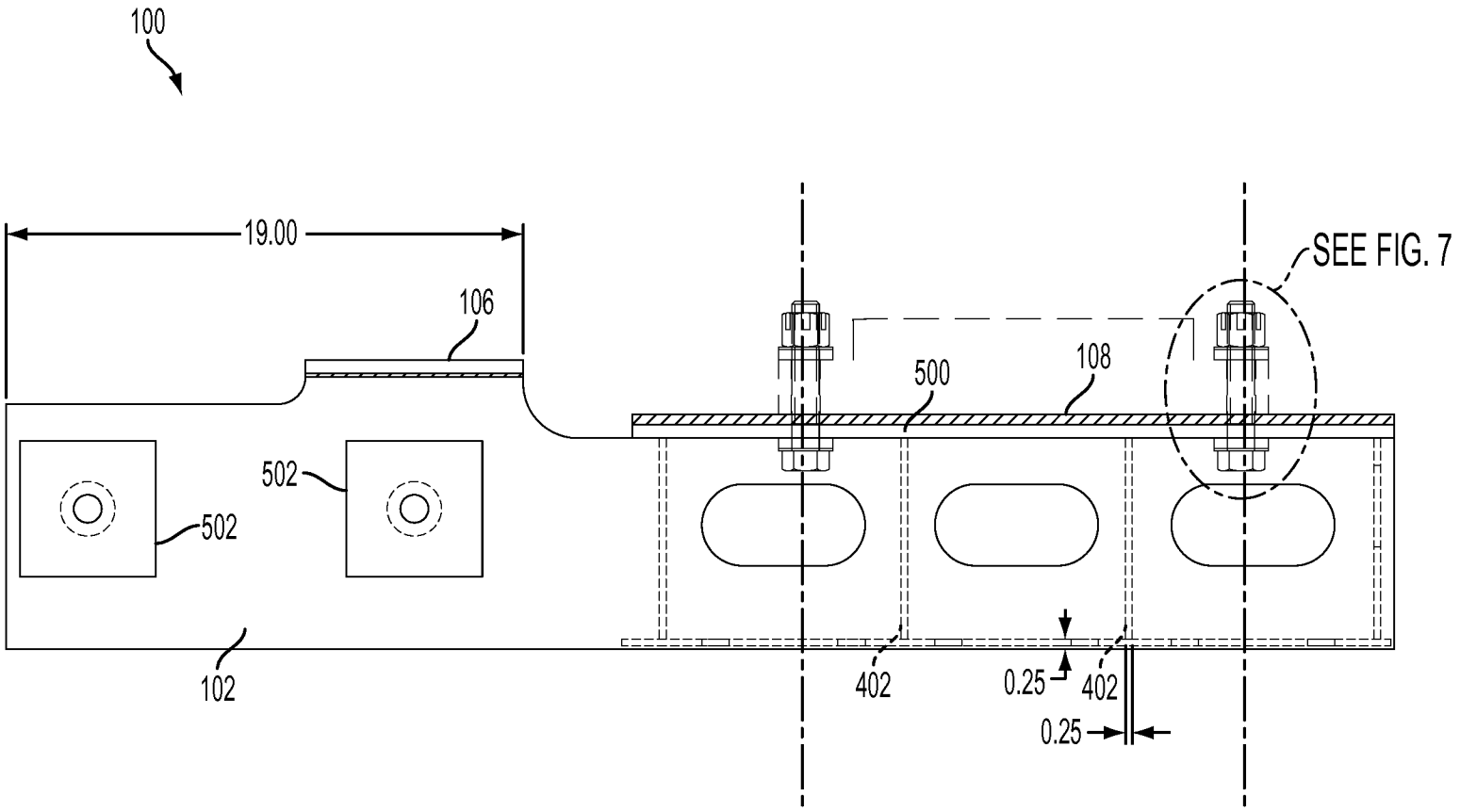
FIG. 5 is a side plan view of the bracket according to an embodiment.

FIG. 5 is a side plan view of the bracket 100 according to an embodiment. As depicted, isolation pad 500 is below connecting support plate 108 and connect sides 102, 104. Connecting support plate 108 is connected to isolation pad 500. Also depicted are mounting bolts through connecting support plate 108 and isolation pad 500 for retaining a device atop bracket 100. Also depicted are a pair of shims 502. Each shim 502 has a thickness which varies from top to bottom of side 102 in order to compensate for the trapezoidal cross section shape of bracket 100, in at least some embodiments. Compensating for the shape of bracket 100 enables the face of nuts affixed to anchor rod 400 to apply even pressure to the face of the corresponding side. Each shim is welded to side 102. In at least some other embodiments, shim 502 is adhered to side 102 using another suitable mechanism. In at least some embodiments, shims 502 are optional.

Figure 6:
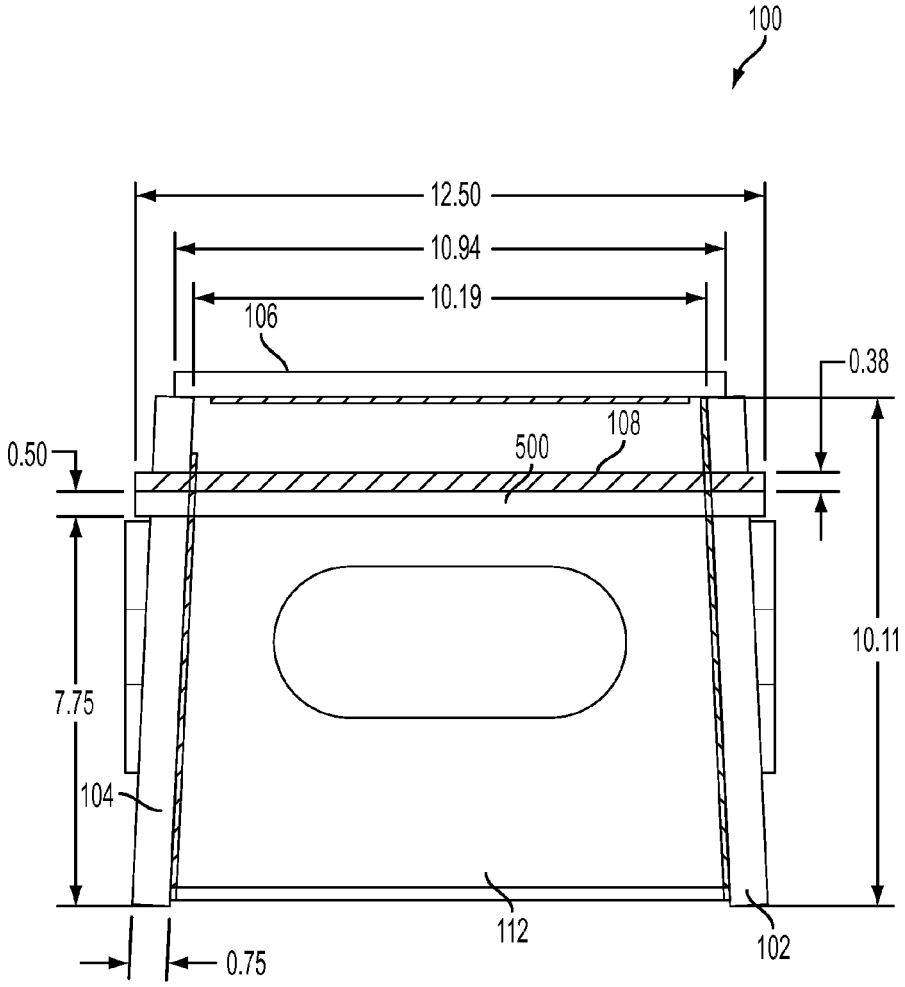
FIG. 6 is an end plan view of the bracket according to an embodiment.

FIG. 6 is an end plan view of the bracket 100 according to an embodiment. As depicted, rear connecting plate 112 has a trapezoidal shape.

Figure 7:
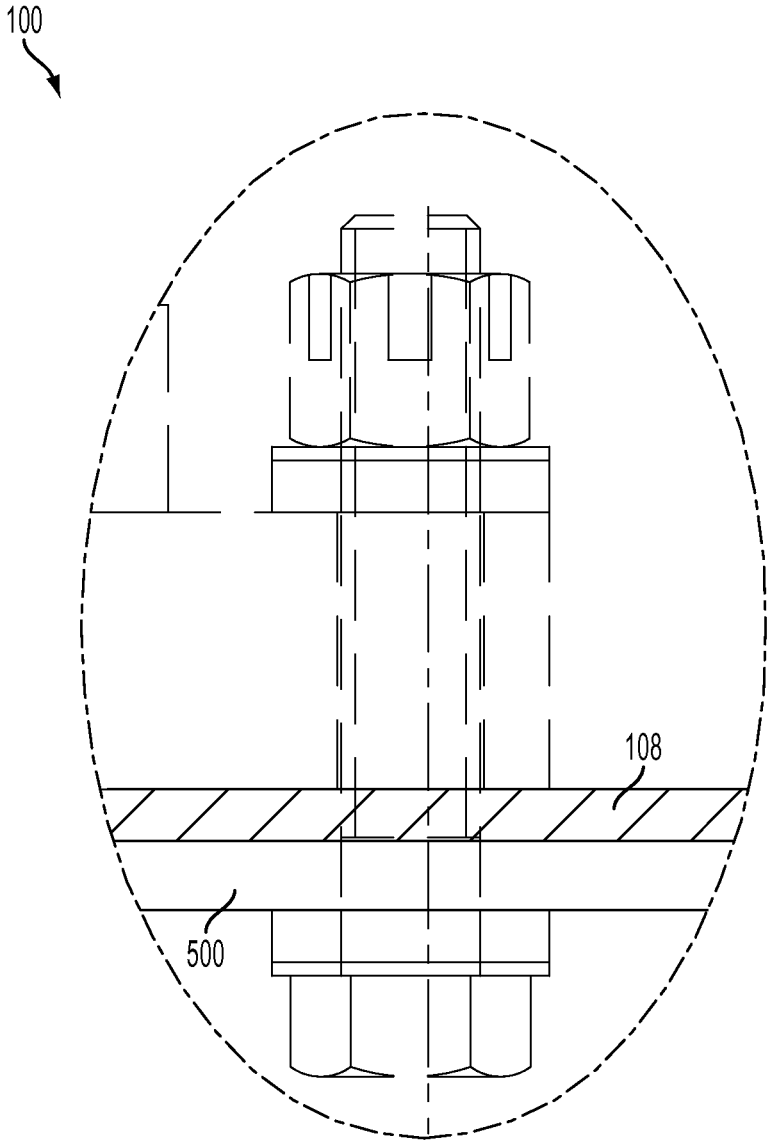
FIG. 7 is a side partial view of a mounting configuration for use with the bracket according to an embodiment.

FIG. 7 is a side partial view of a mounting configuration for use with the bracket 100 according to an embodiment.

Figure 8:
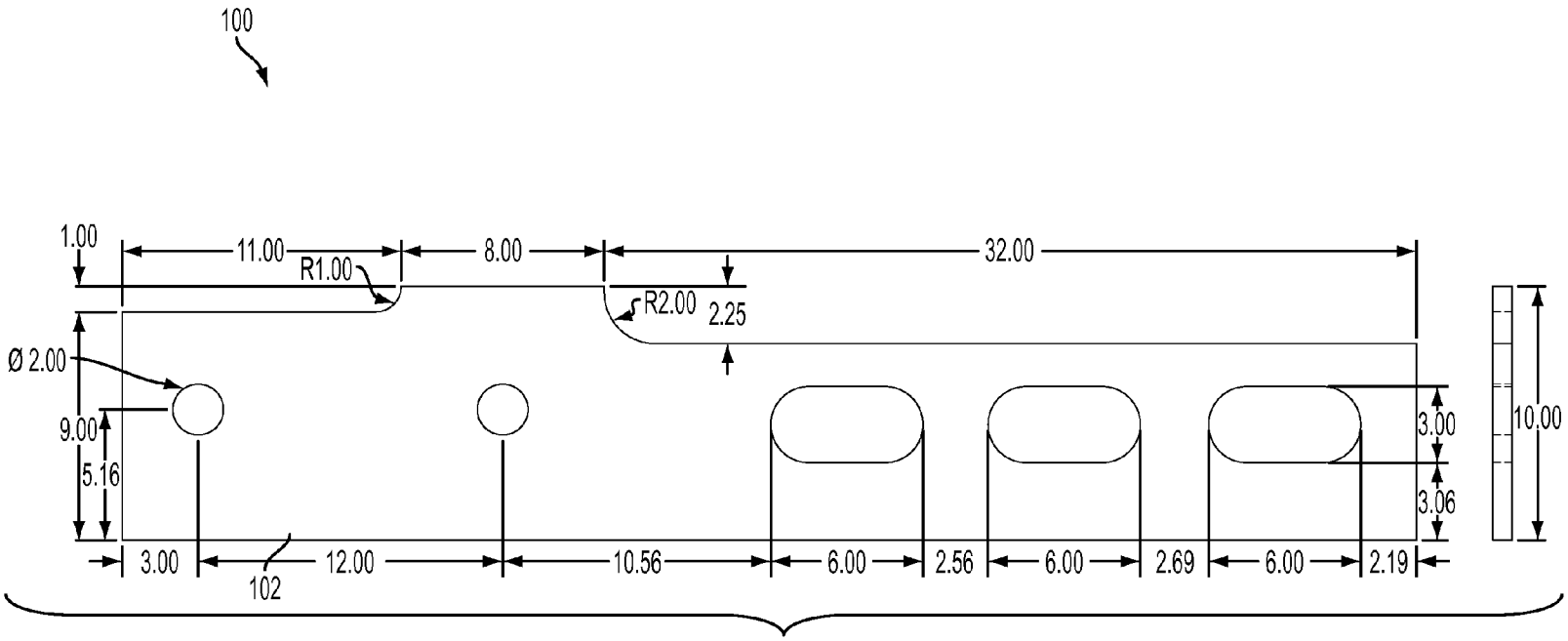
FIG. 8 is a side plan view of a side of the bracket according to an embodiment.

FIG. 8 is a side plan view of side 102 of the bracket 100 according to an embodiment.

Figure 9:
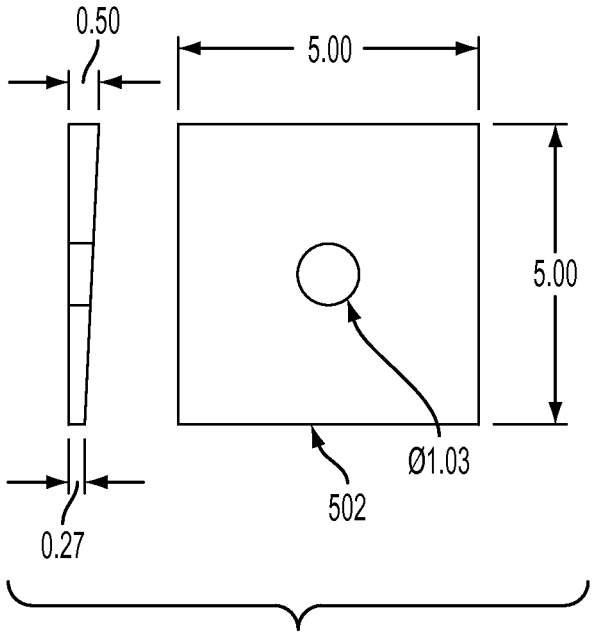
FIG. 9 is a side and plan view of a shim according to an embodiment.

FIG. 9 is a side and plan view of shim 502 according to an embodiment. Shim 502 varies in thickness becoming wider at the top as compared to the bottom. In at least some embodiments, shim 502 varies in thickness in order that nuts or other mechanisms securing bracket 100 to a tie are able to apply even pressure to the sides of the bracket. In at least some embodiments, shim 502 is a uniform thickness. In at least some embodiments, bracket 100 has sides 102, 104 which do not slope toward each other. In at least some embodiments, sides 102, 104 are oriented in a parallel manner with respect to each other.

Figure 10:
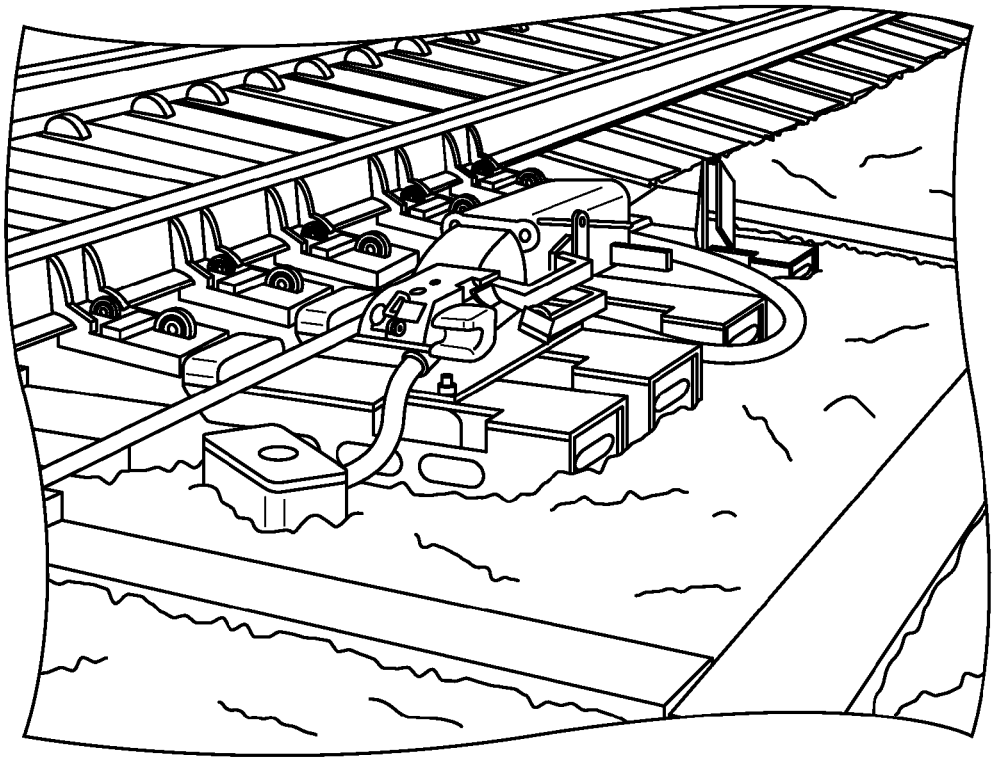
FIG. 10 is a perspective view of a plurality of brackets in use according to an embodiment.

FIG. 10 is a perspective view of a plurality of brackets in use according to an embodiment. Each bracket 100 is positioned and connected to a corresponding tie and extending away from the rail being supported by the tie. A manually operated switch is depicted as being supported on the connecting support plate 108 of three of the brackets. The depicted bracket differs from bracket 100 in that the bracket includes a cutout opening along the intersection of the connecting support plate 108 and the side 104. The cutout opening provides additional access to the interior of the bracket. In at least some embodiments, the cutout opening may be of different dimensions and/or have a different position on the bracket. In at least some embodiments, the bracket has no cutout openings at the intersection of one of the sides and the connecting support plate.

Figure 11:
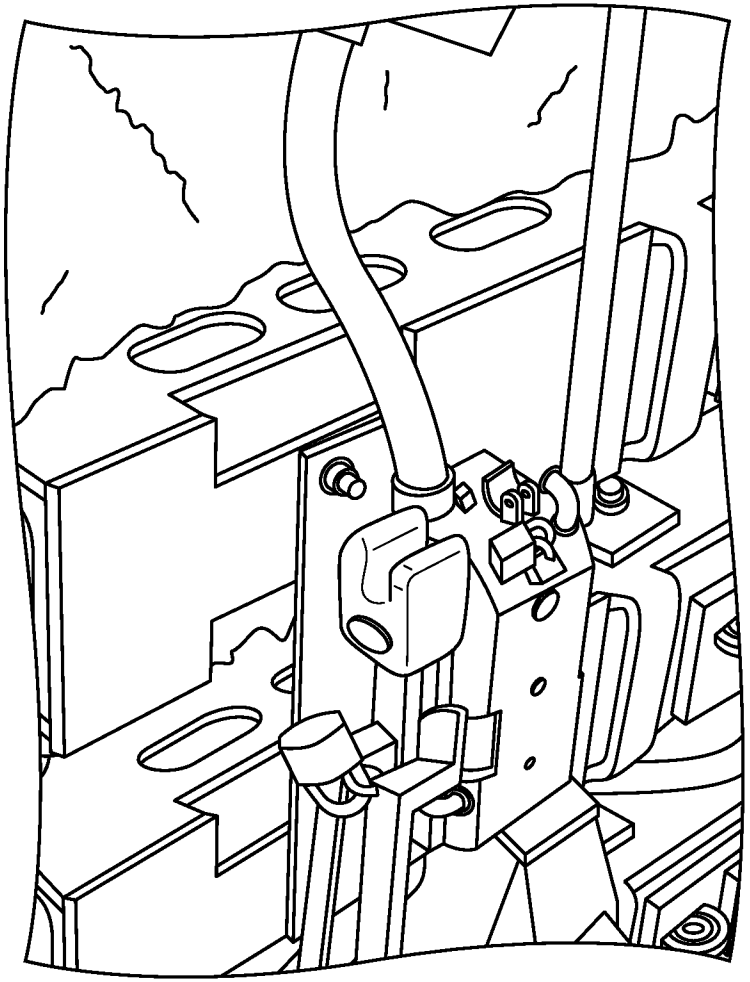
FIG. 11 is a detailed perspective view of a portion of the plurality of brackets in use according to the FIG. 10 embodiment.

FIG. 11 is a detailed perspective view of a portion of the plurality of brackets in use according to the FIG. 10 embodiment. Cutout openings on either side of the depicted bracket are more clearly visible in the Figure.

Figure 12:
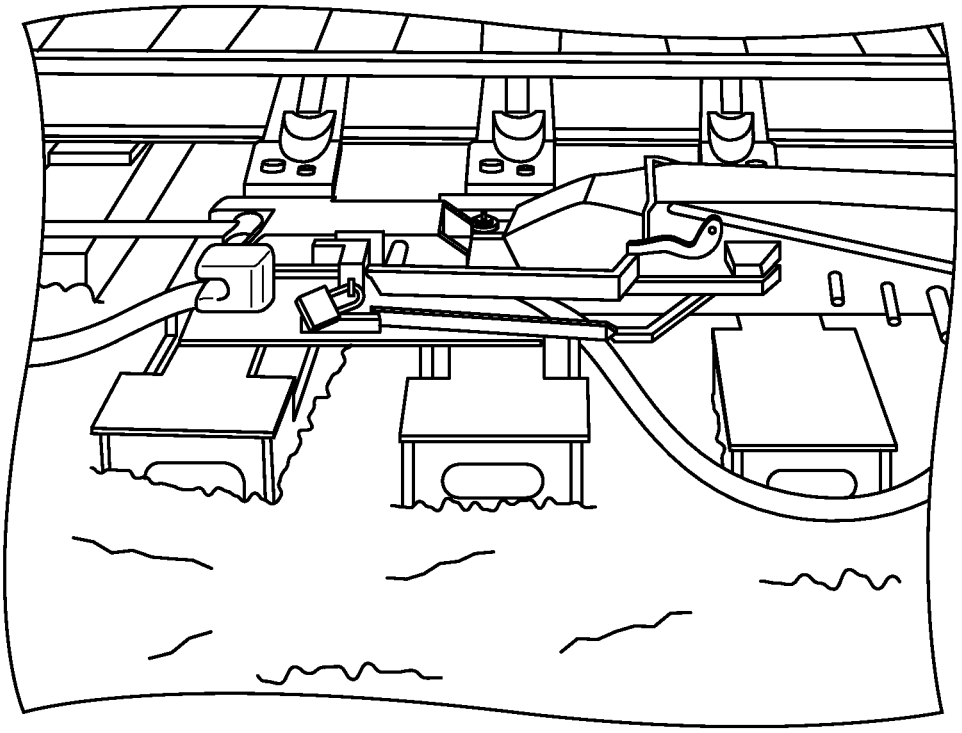
FIG. 12 is a side perspective view of the plurality of brackets in use according to the FIG. 10 embodiment.

FIG. 12 is a side perspective view of the plurality of brackets in use according to the FIG. 10 embodiment. The extension of the switch across three of the depicted brackets is visible in the Figure. Additionally, the right hand most depicted bracket is seen to have a slightly different position and dimension from the other two brackets.

Figure 13:
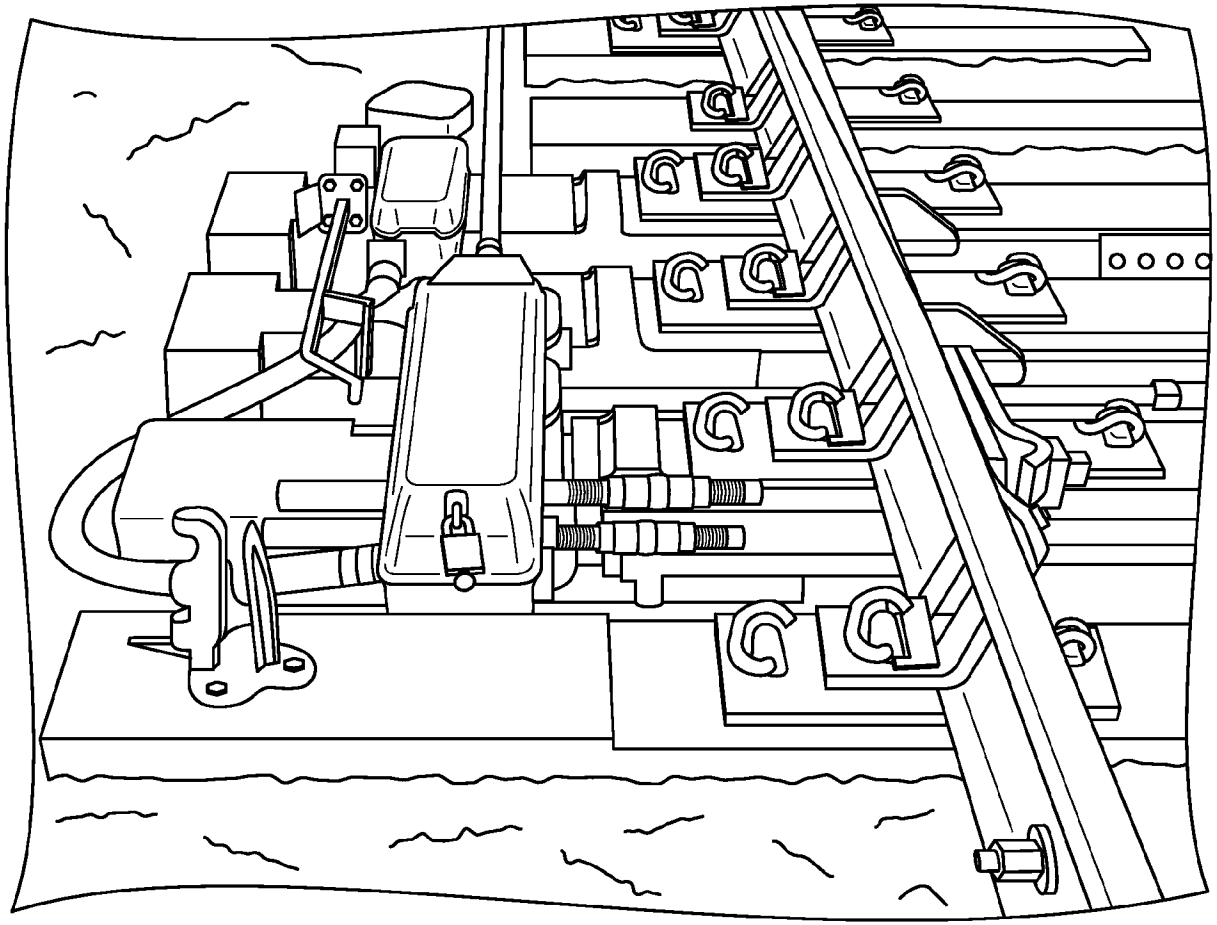
FIG. 13 is an end perspective view of the plurality of brackets in use according to the FIG. 10 embodiment.

FIG. 13 is an end perspective view of the plurality of brackets in use according to the FIG. 10 embodiment.

Figure 14:
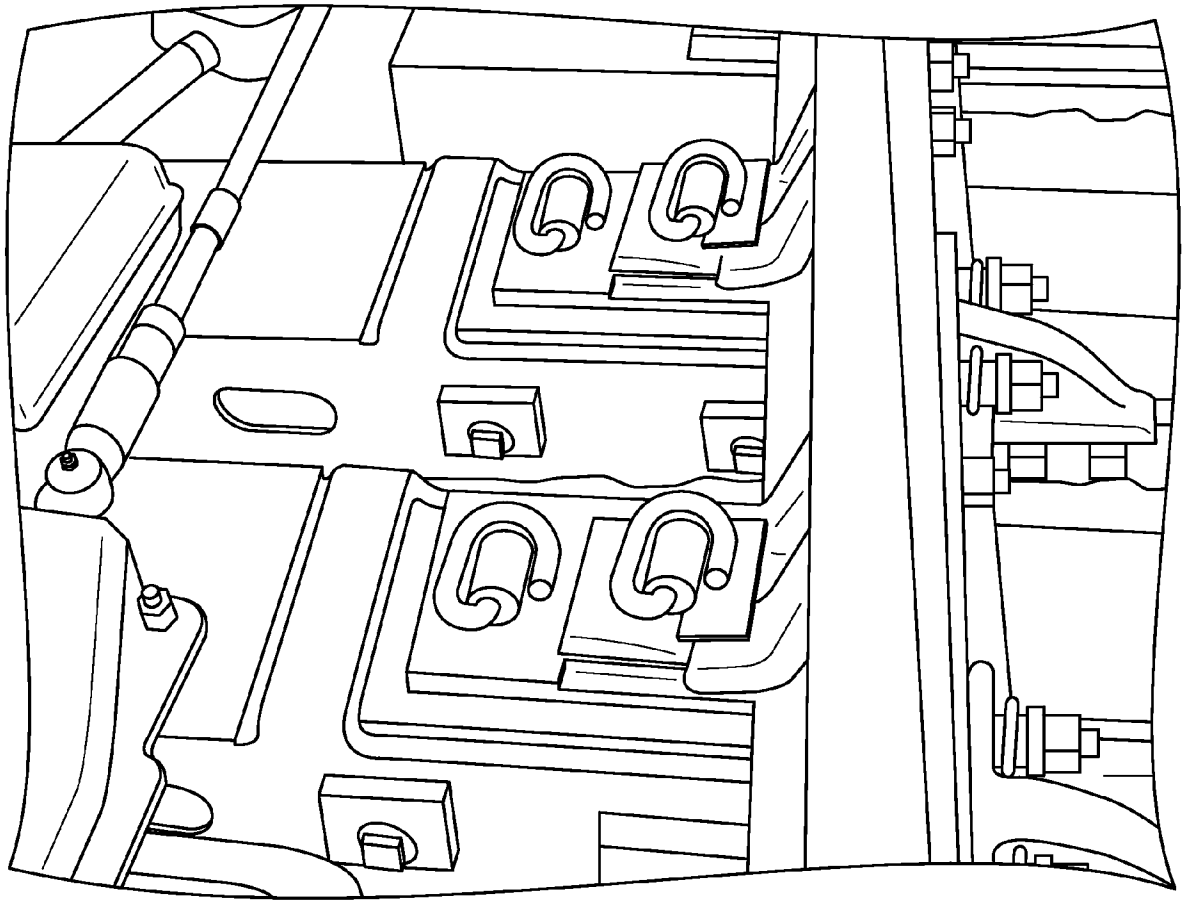
FIG. 14 is a detailed top perspective view of a portion of the plurality of brackets in use according to the FIG. 10 embodiment.

FIG. 14 is a detailed top perspective view of a portion of the plurality of brackets in use according to the FIG. 10 embodiment. At least one anchor rod 400 in position through shims 502 and bracket 100 is clearly visible in the Figure. Top connecting plate 106 positioned over top of the tie to which it is connected is clearly visible in the Figure. The depicted top connecting plate has a narrower width than top connecting plate 106. In at least some embodiments, top connecting plate may have a larger or smaller width.

Figure 15:
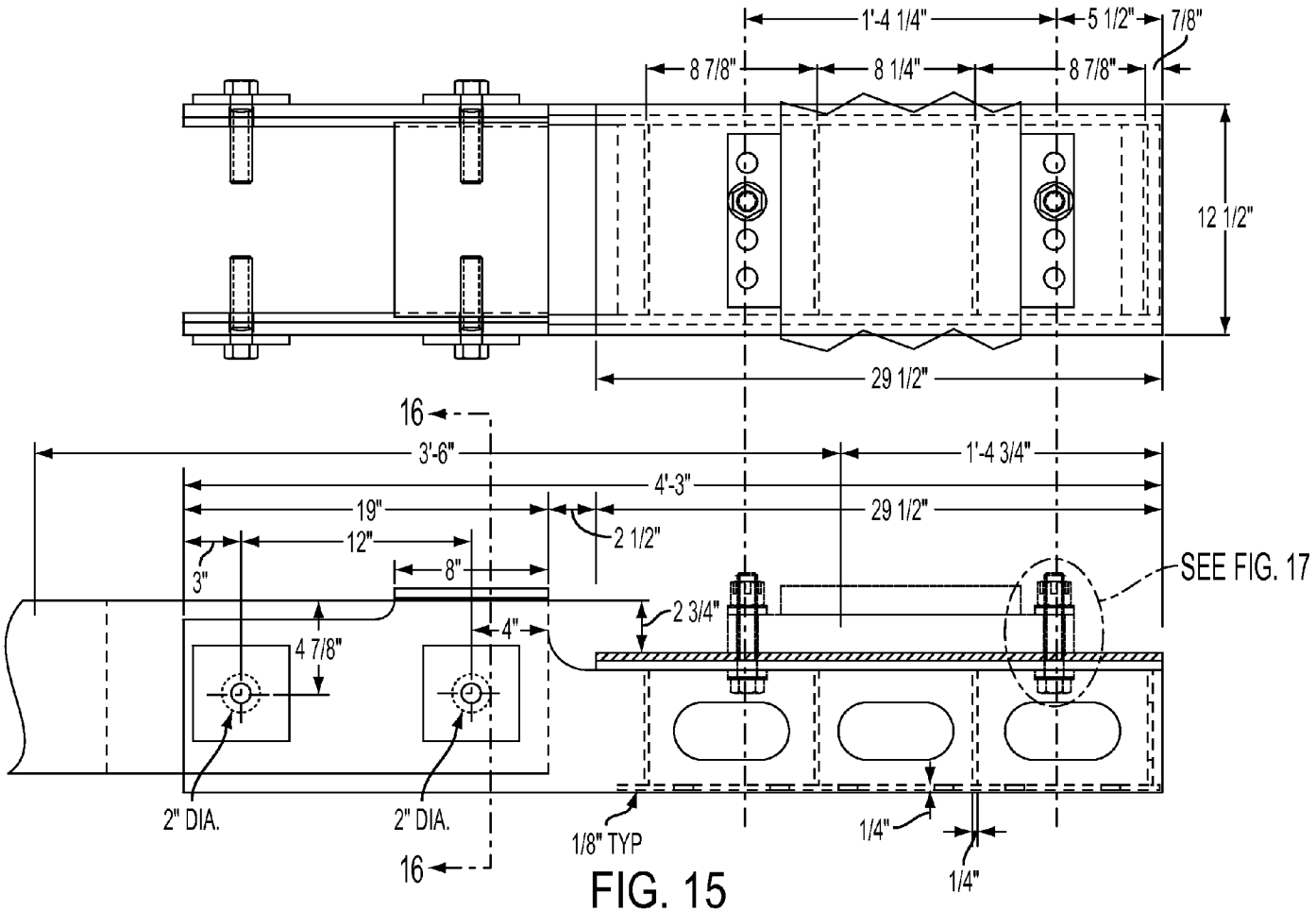
FIGS. 15-26 are views of a tie extension bracket according to another embodiment.
Figure 18:
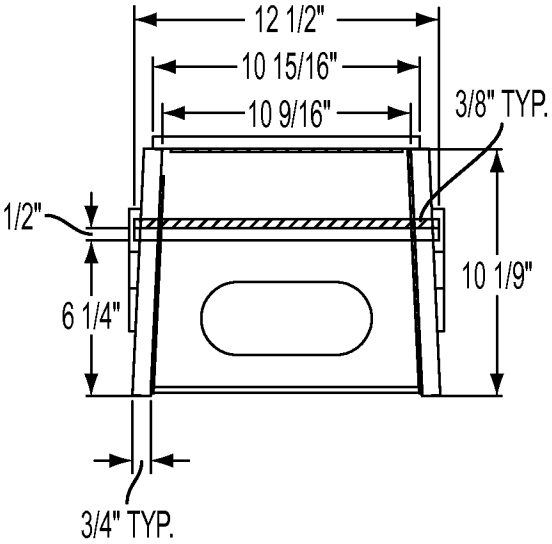
Figure 17:
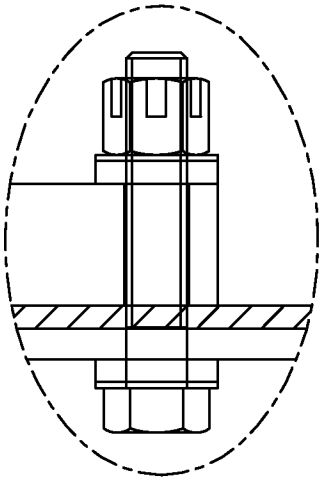
Figure 16:
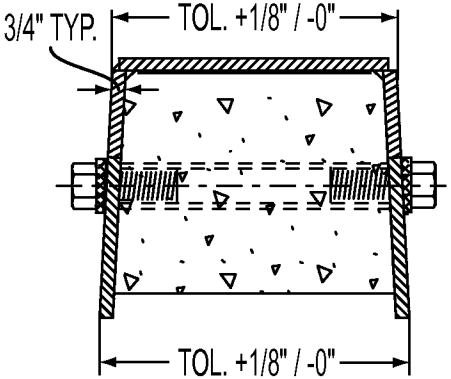
Figure 19:
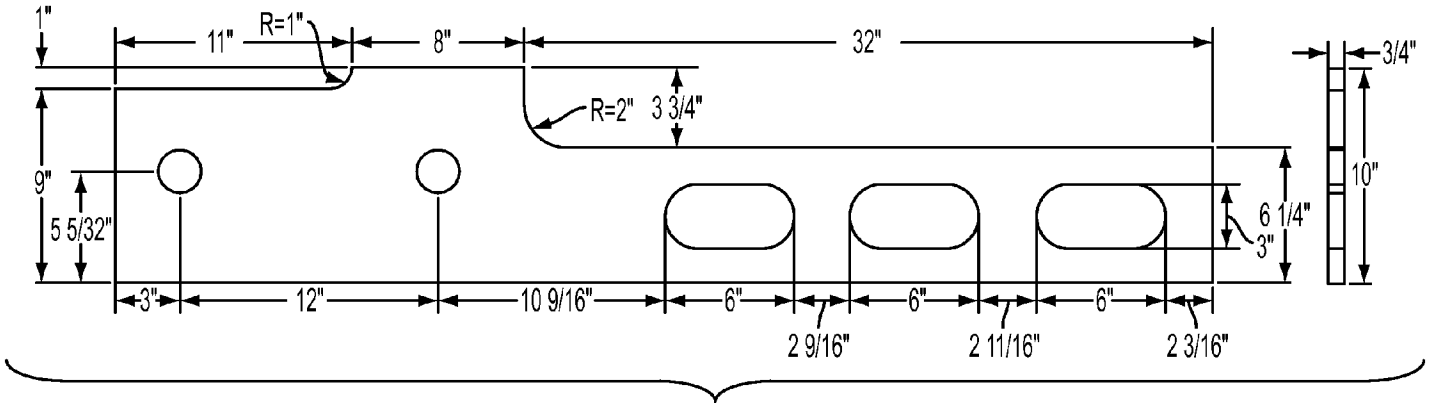
Figure 21:
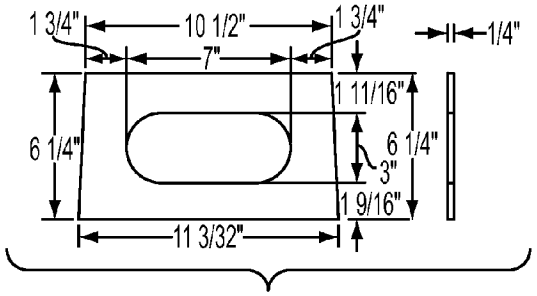
Figure 20:
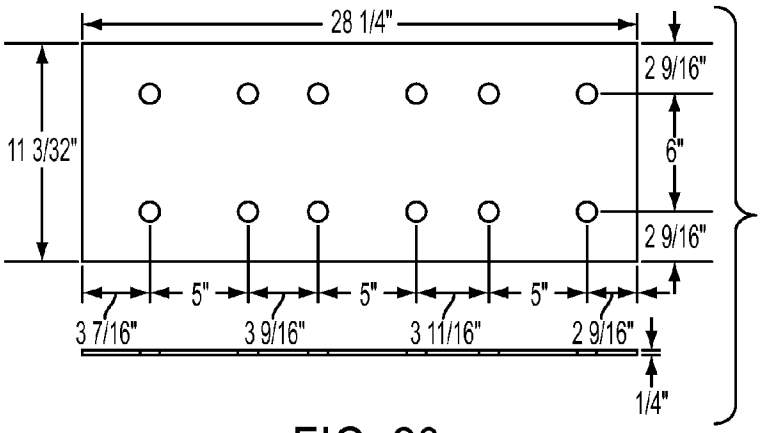
Figure 23:
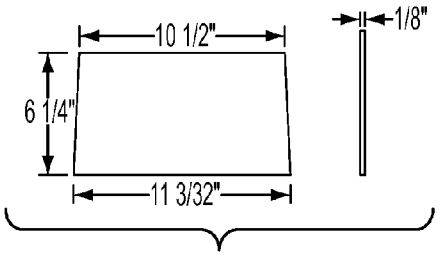
Figure 26:
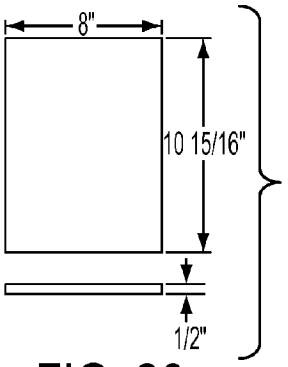
Figure 22:
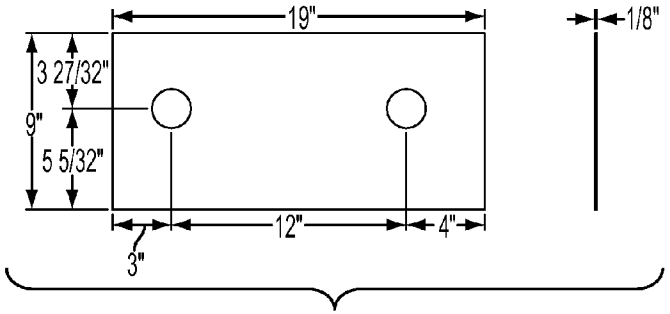
Figure 25:
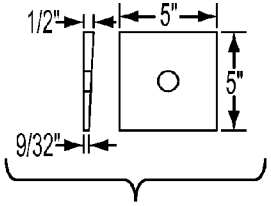
Figure 24:
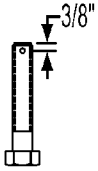

FIGS. 15-26 are plan views of a tie extension bracket according to another embodiment. FIG. 15 is a top view and a corresponding side view of the tie extension bracket. FIG. 16 is a section view through section A-A of the bracket of FIG. 15. FIG. 17 is an enlarged view of a retaining bolt positioned through connecting support plate 108. FIG. 18 is an end view of the bracket of FIG. 15. FIG. 19 is a side plan view of the FIG. 15 bracket. FIG. 20 is a top view of the connecting support plate 108 of the FIG. 15 bracket showing an arrangement of throughholes for receiving a retaining bolt therethrough. FIG. 21 is a plan view of the rear connecting plate 112 of the FIG. 15 bracket. FIG. 23 is a plan view and a corresponding end view of internal plate 402. FIG. 24 is a plan view of anchor rod 400 according to an embodiment. FIG. 25 is a side view and a corresponding plan view of shim 502 according to the FIG. 15 embodiment. FIG. 26 is a plan view and a corresponding end view of top connecting plate 106 according to the FIG. 15 embodiment.

Figure 27:
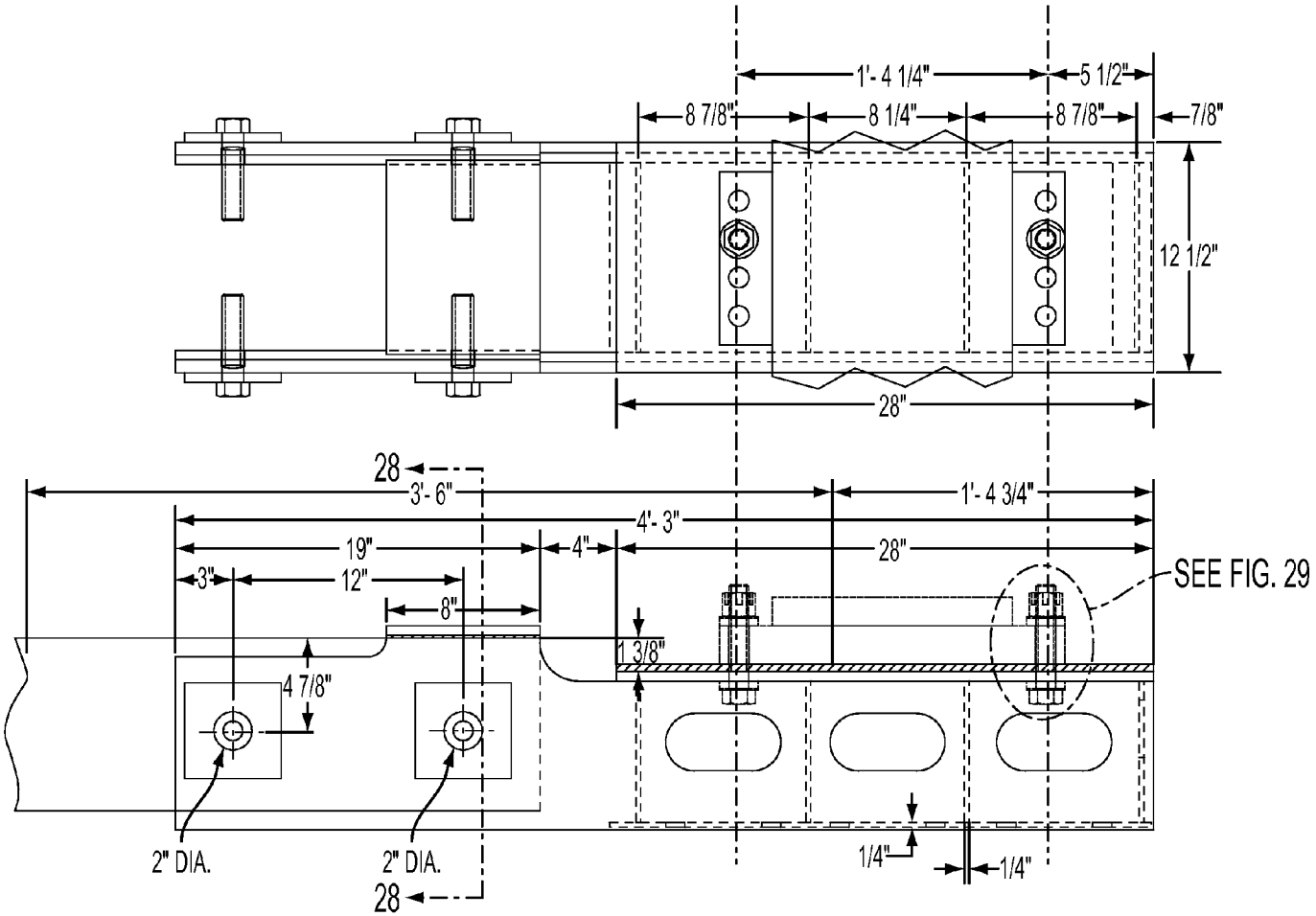
FIGS. 27-38 are views of a tie extension bracket according to another embodiment.
Figure 30:
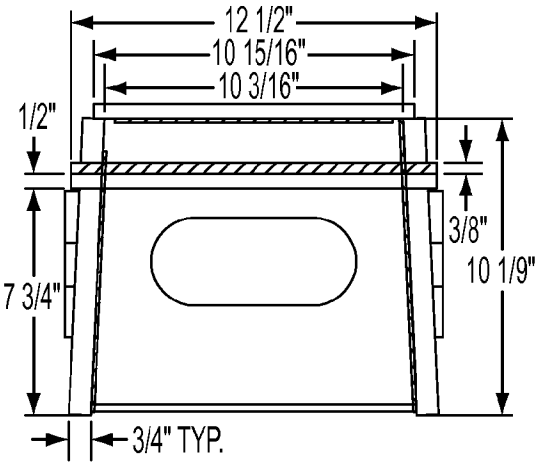
Figure 29:
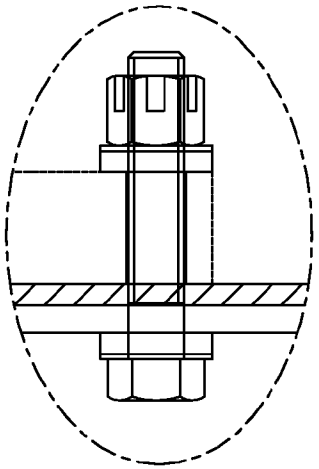
Figure 28:
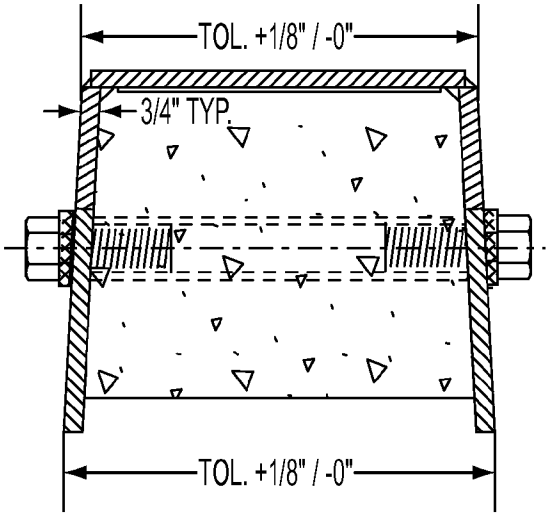
Figure 31:
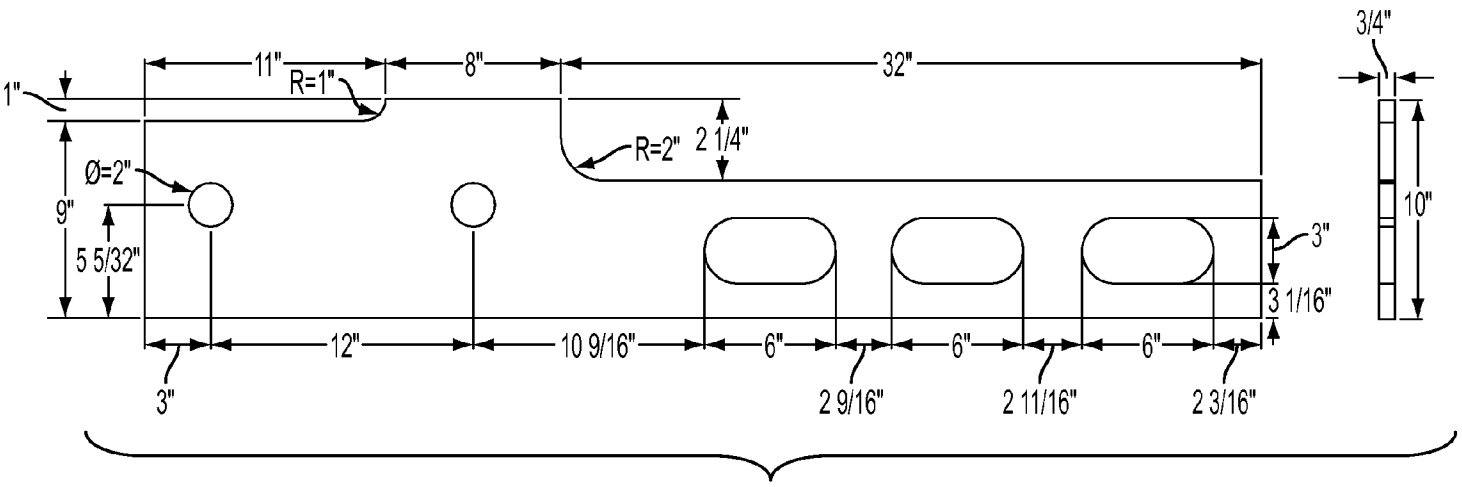
Figure 33:
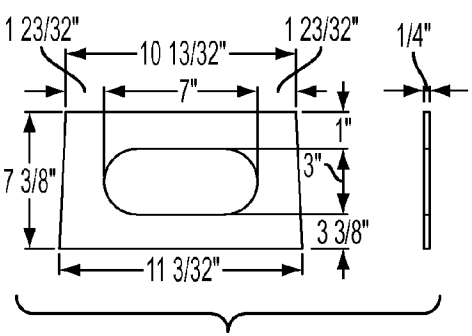
Figure 32:
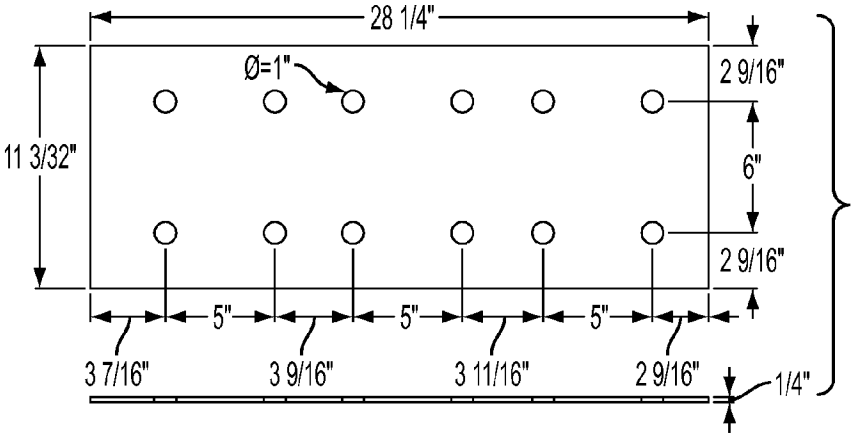
Figure 35:
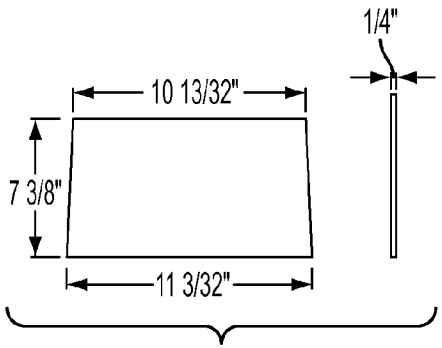
Figure 38:
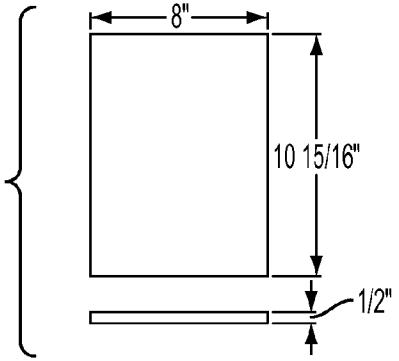
Figure 34:
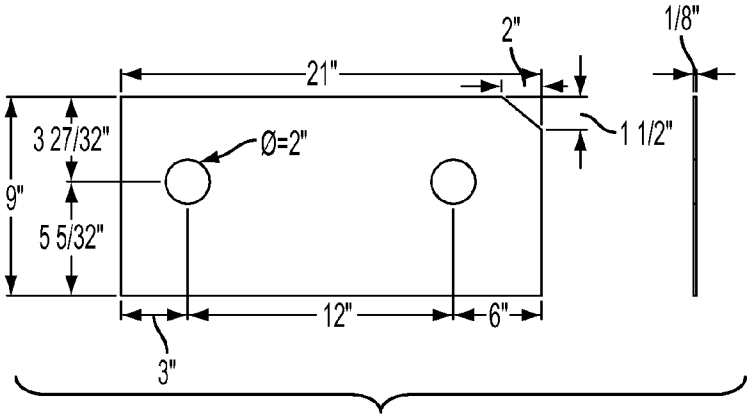
Figure 37:
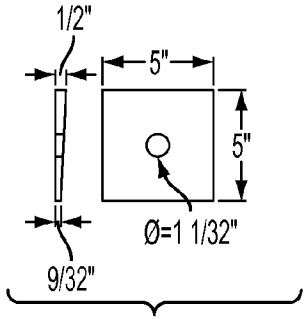
Figure 36:
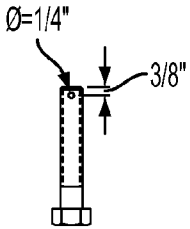

FIGS. 27-38 are views of a tie extension bracket according to another embodiment. FIG. 27 is a top view and a corresponding side view of the tie extension bracket. It is noted that the height of the FIG. 27 bracket is less than the height of the FIG. 15 bracket. FIG. 28 is a section view through section A-A of the bracket of FIG. 27. FIG. 29 is an enlarged view of a retaining bolt positioned through connecting support plate 108. FIG. 30 is an end view of the bracket of FIG. 27. FIG. 31 is a side plan view of the FIG. 27 bracket. FIG. 32 is a top view of the connecting support plate 108 of the FIG. 27 bracket showing an arrangement of throughholes for receiving a retaining bolt therethrough. FIG. 33 is a plan view of the rear connecting plate 112 of the FIG. 27 bracket. FIG. 35 is a plan view and a corresponding end view of internal plate 402. FIG. 36 is a plan view of anchor rod 400 according to an embodiment. FIG. 37 is a side view and a corresponding plan view of shim 502 according to the FIG. 27 embodiment. FIG. 38 is a plan view and a corresponding end view of top connecting plate 106 according to the FIG. 27 embodiment.

Figure 39:
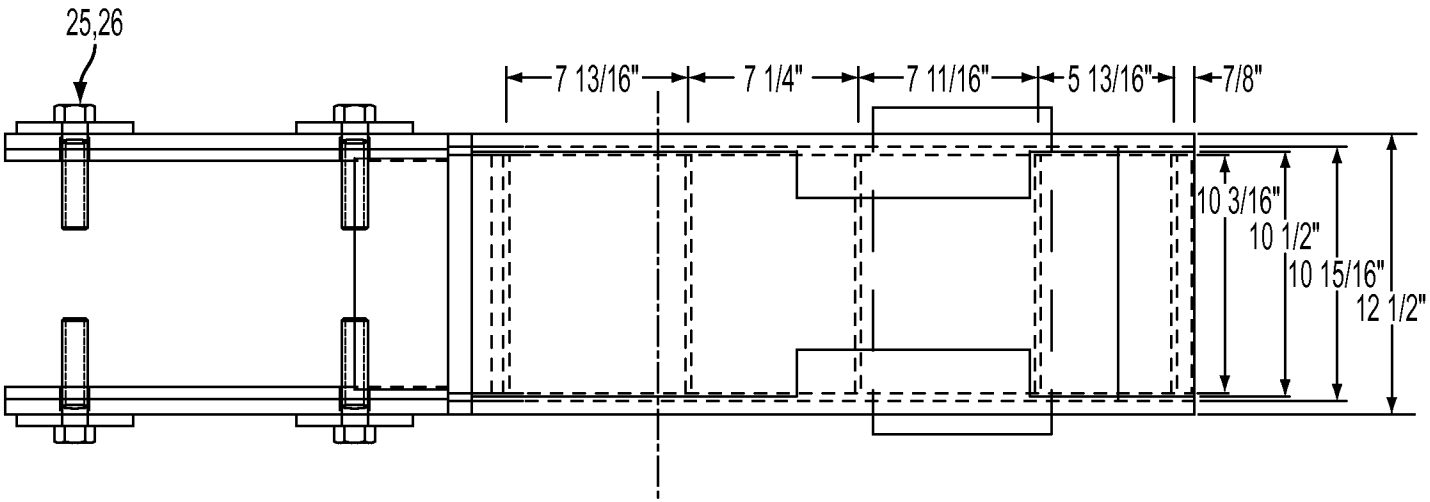
FIGS. 39-54 are views of a tie extension bracket according to another embodiment.
Figure 40:
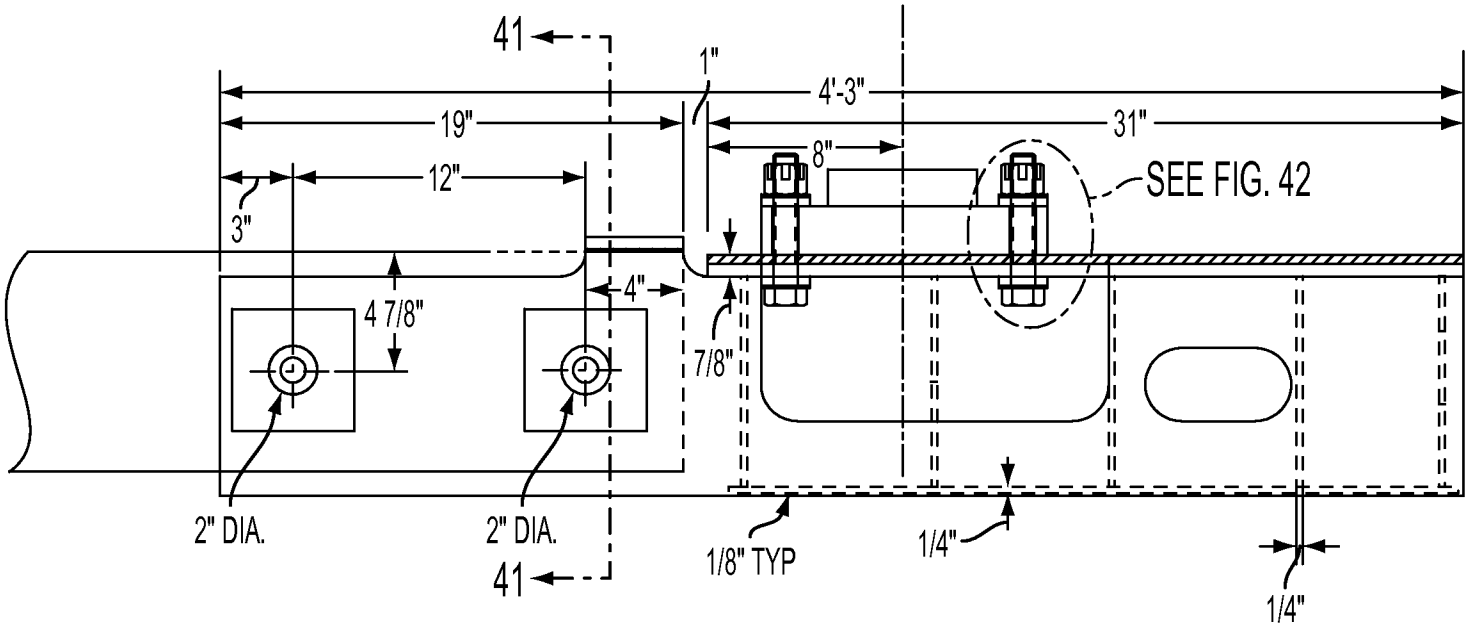
Figure 41:
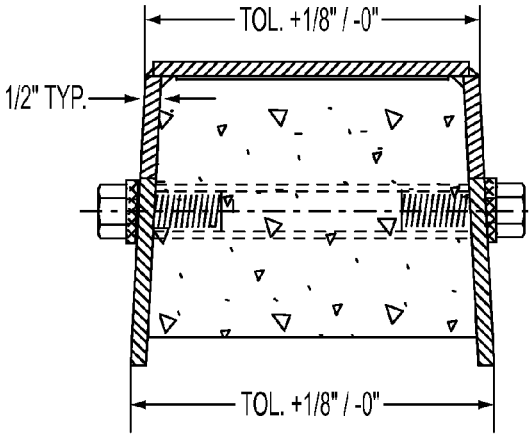
Figure 42:
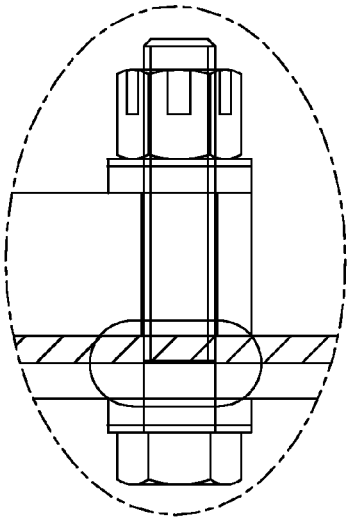
Figure 43:
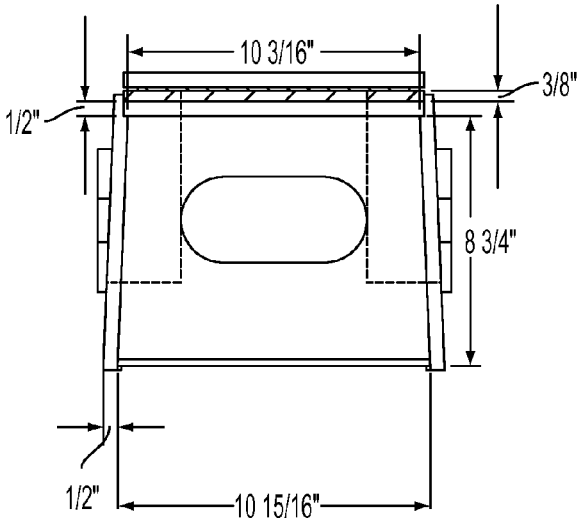
Figure 44:
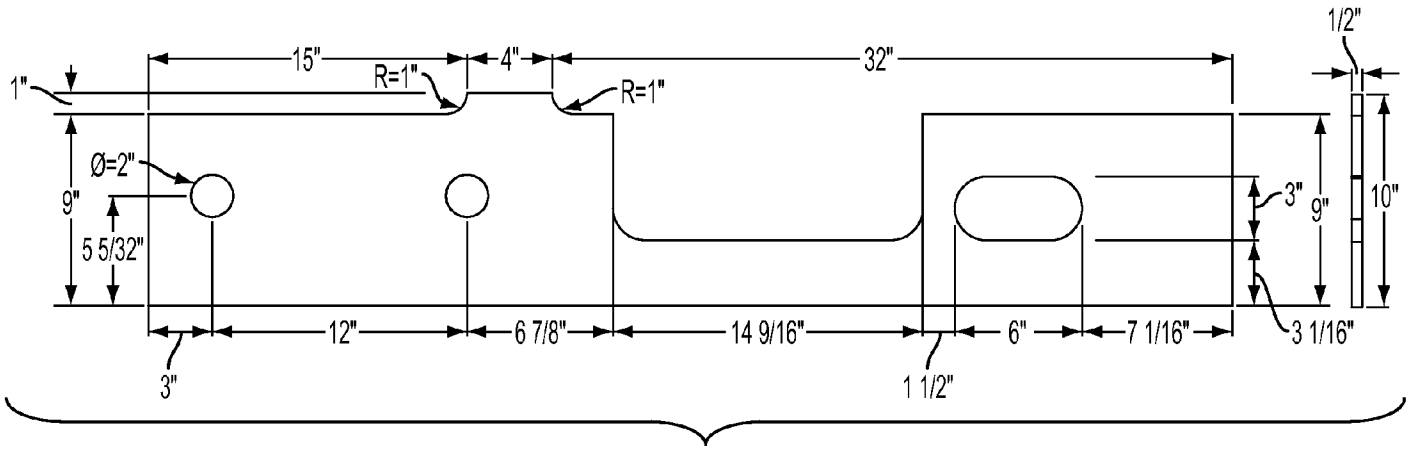
Figure 46:
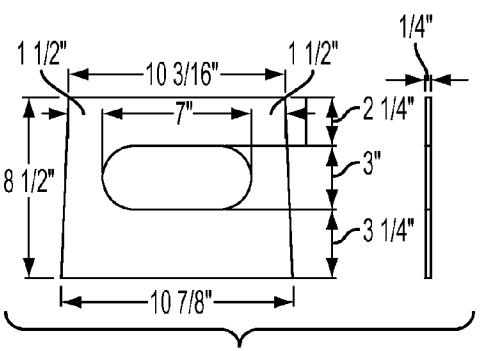
Figure 45:
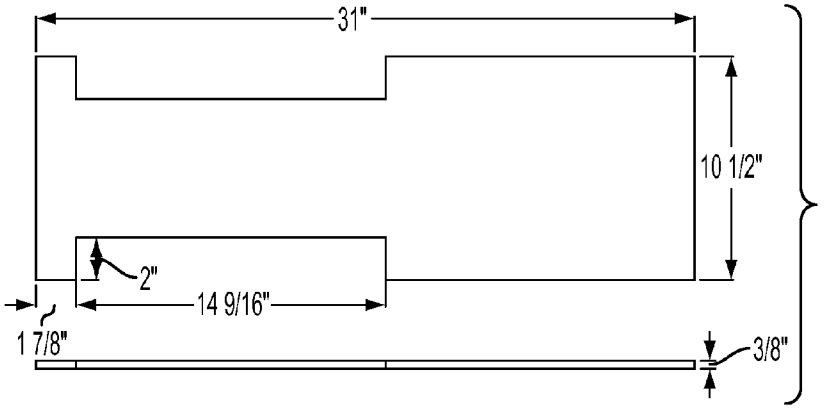
Figure 48:
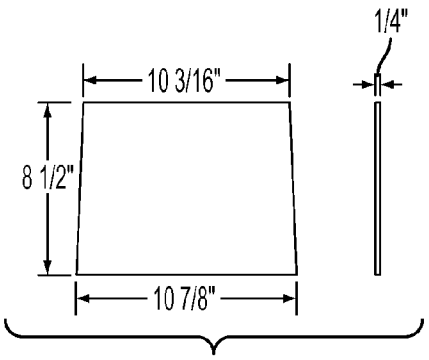
Figure 47:
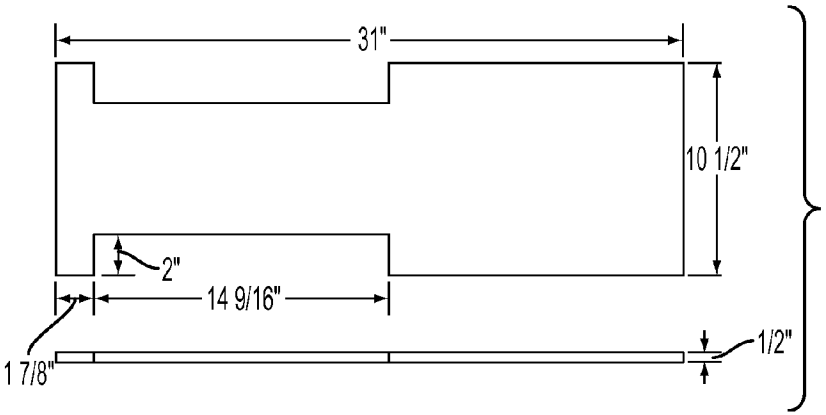
Figure 50:
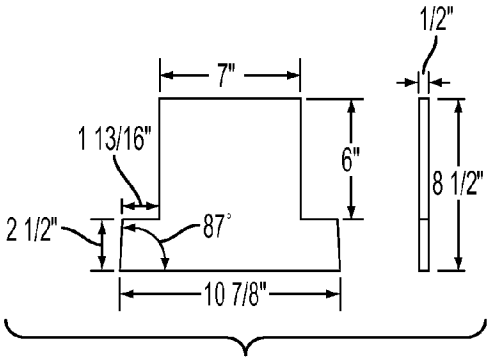
Figure 49:
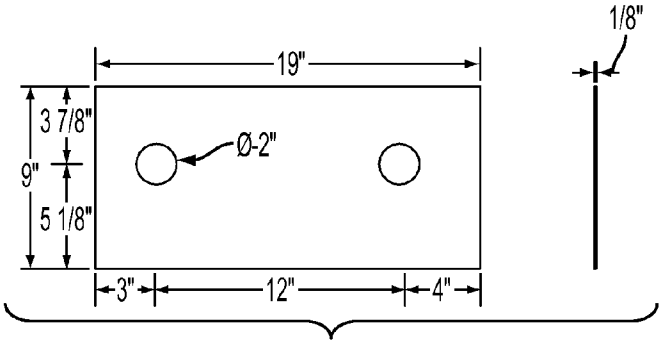
Figure 51:
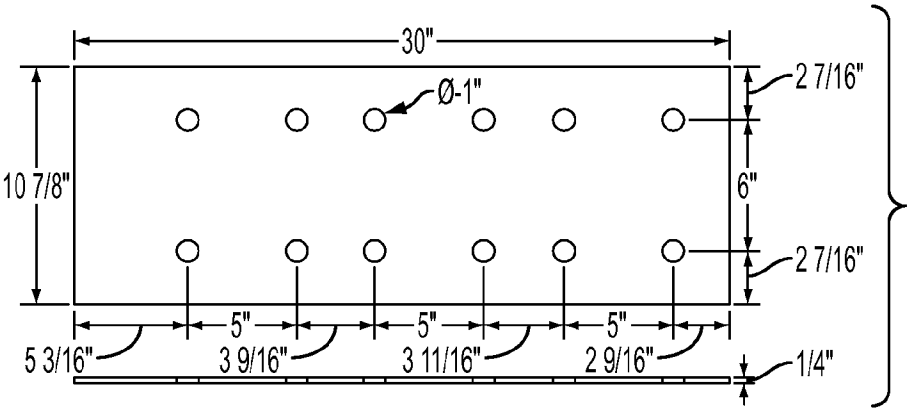
Figure 54:
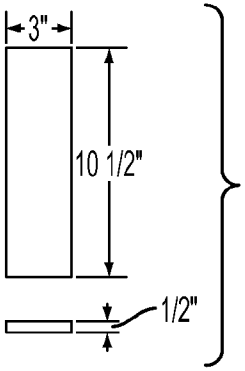
Figure 53:
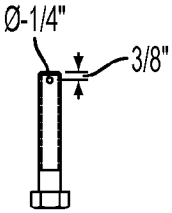
Figure 52:
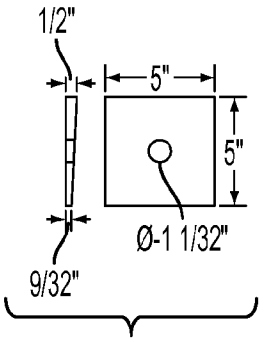

FIGS. 39-54 are views of a tie extension bracket according to another embodiment. FIG. 39 is a top view of the tie extension bracket. FIG. 40 is a side view of the FIG. 39 tie extension bracket. FIG. 41 is a section view through section A-A of the bracket of FIG. 39. FIG. 42 is an enlarged view of a retaining bolt positioned through connecting support plate 108. FIG. 43 is an end view of the bracket of FIG. 39. FIG. 44 is a side plan view of the FIG. 39 bracket. FIG. 45 is a top view of the connecting support plate 108 of the FIG. 39 bracket. FIG. 46 is a plan view of the rear connecting plate 112 of the FIG. 39 bracket. FIG. 47 is a top view and a corresponding side view of top connecting plate 106 according to the FIG. 39 bracket. FIG. 48 is a plan view and a corresponding end view of internal plate 402. FIG. 50 is a plan view and a corresponding end view of another internal plate 402 according to the FIG. 39 bracket. The FIG. 50 internal plate is shaped different from the FIG. 48 internal plate in order to accommodate the cutout opening of the FIG. 39 bracket. FIG. 51 is a top view of top connecting plate 106 according to the FIG. 39 bracket. FIG. 52 is a side view and a corresponding plan view of shim 502 according to the FIG. 39 embodiment. FIG. 53 is a plan view of anchor rod 400 according to an embodiment. FIG. 54 is a plan view and a corresponding end view of top connecting plate 106 according to the FIG. 39 embodiment.

Figure 55:
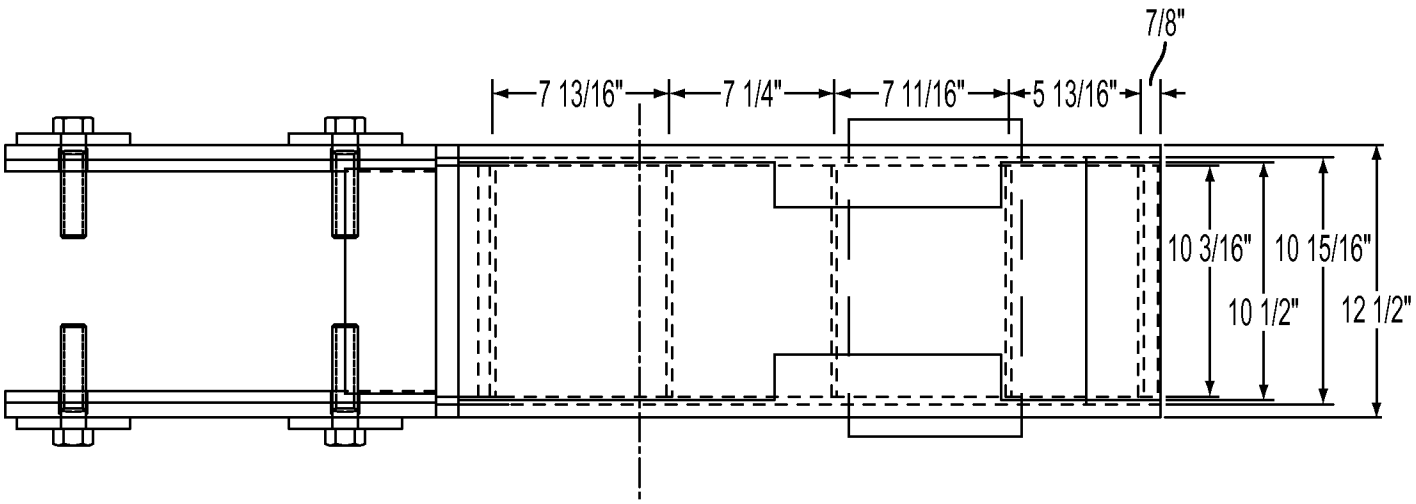
FIGS. 55-69 are views of a tie extension bracket according to another embodiment.
Figure 56:
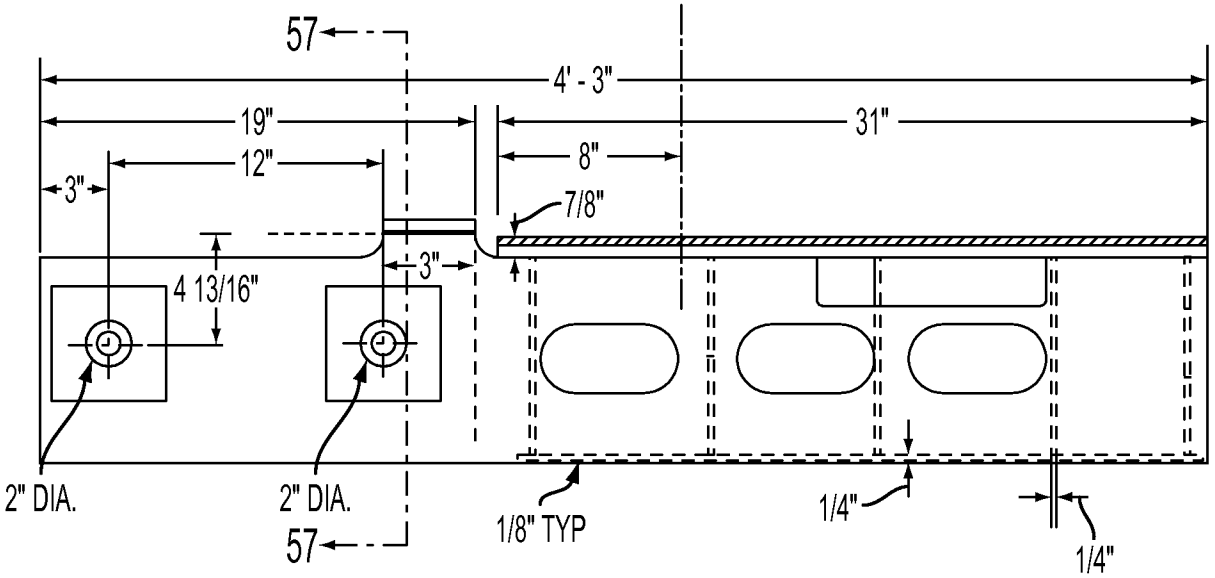
Figure 59:
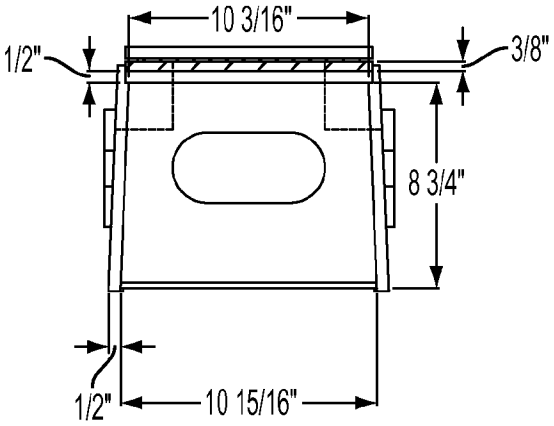
Figure 58:
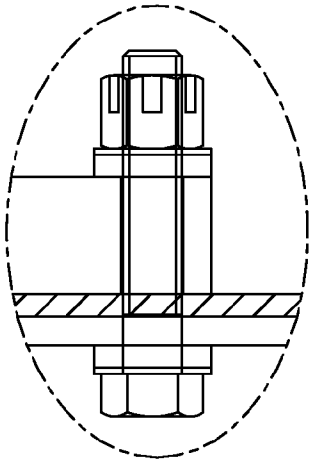
Figure 57:
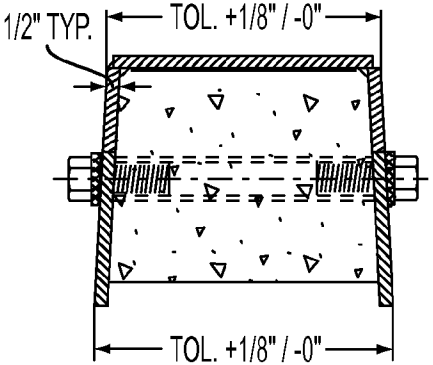
Figure 60:
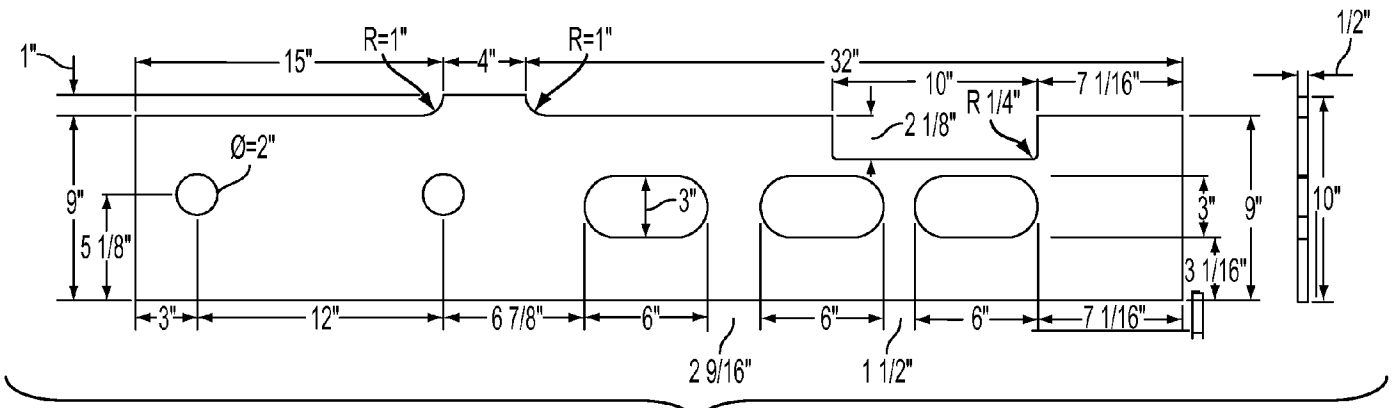
Figure 62:
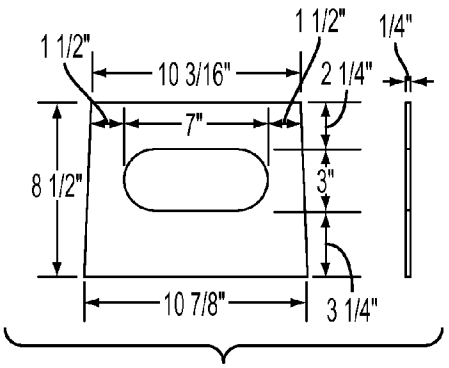
Figure 61:
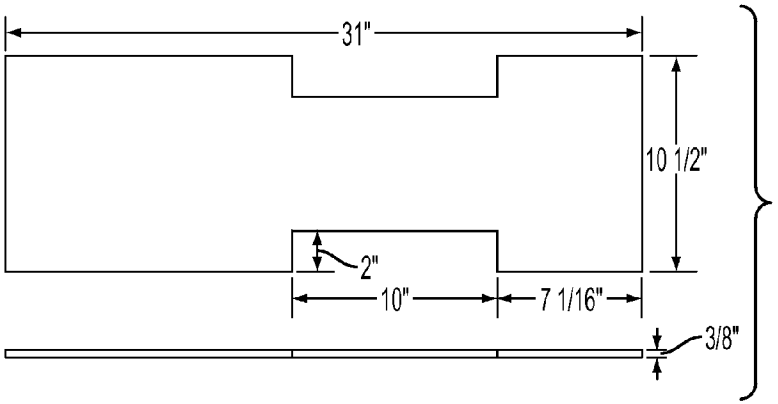
Figure 63:
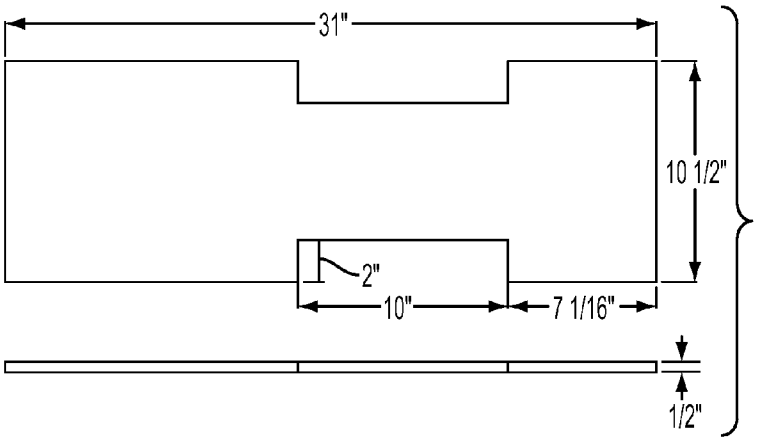
Figure 64:
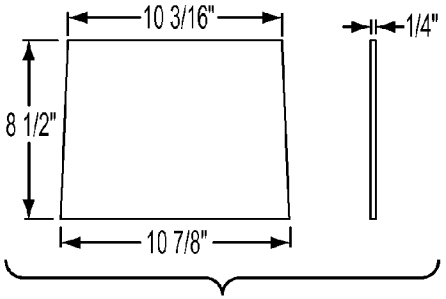
Figure 65:
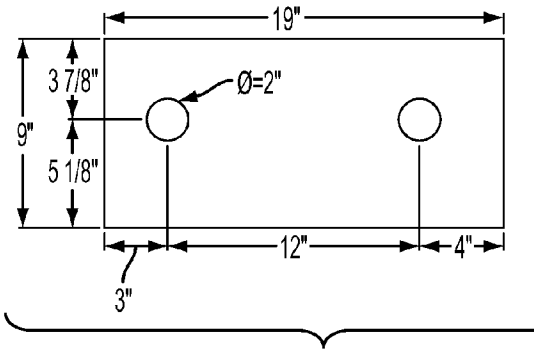
Figure 66:
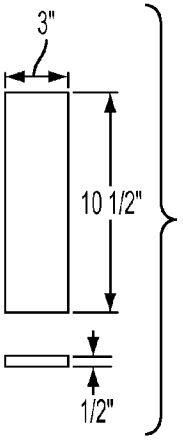
Figure 69:
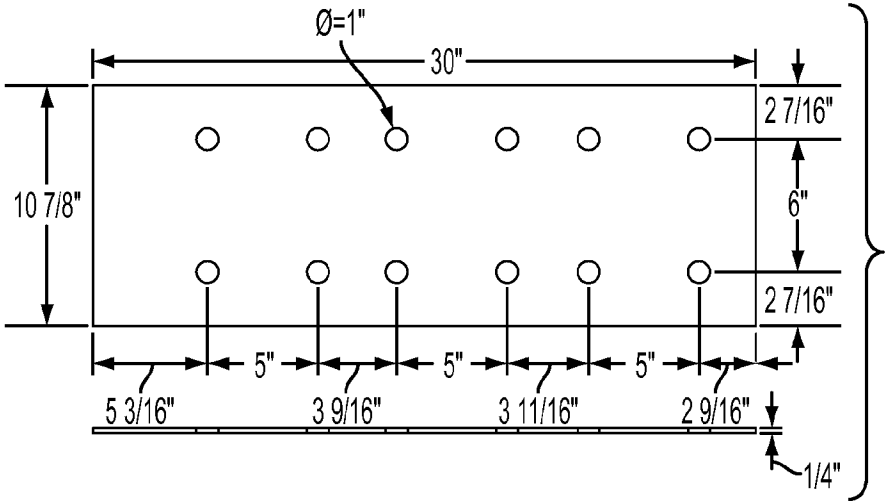
Figure 68:
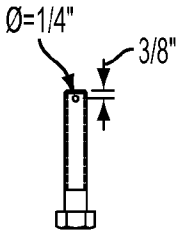
Figure 67:
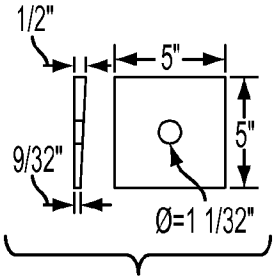

FIGS. 55-69 are views of a tie extension bracket according to another embodiment. FIG. 55 is a top view of the tie extension bracket. FIG. 56 is a side view of the FIG. 55 tie extension bracket. FIG. 57 is a section view through section A-A of the bracket of FIG. 55. FIG. 58 is an enlarged view of a retaining bolt positioned through connecting support plate 108. FIG. 59 is an end view of the bracket of FIG. 55. FIG. 60 is a side plan view of the FIG. 55 bracket. FIG. 61 is a top view of the connecting support plate 108 of the FIG. 55 bracket. FIG. 62 is a plan view of the rear connecting plate 112 of the FIG. 55 bracket. FIG. 63 is a top view and a corresponding side view of the connecting support plate 108 according to the FIG. 55 bracket. FIG. 64 is a plan view and a corresponding end view of internal plate 402. FIG. 66 is a top view of top connecting plate 106 according to the FIG. 55 bracket. FIG. 67 is a side view and a corresponding plan view of shim 502 according to the FIG. 55 embodiment. FIG. 68 is a plan view of anchor rod 400 according to an embodiment. FIG. 69 is a plan view and a corresponding end view of top connecting plate 106 according to the FIG. 55 embodiment.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A tie extension bracket comprising:

a rectangular-shaped box having at least three sides, two of the sides being arranged parallel to each other and the remaining side being a connecting support plate connecting the two parallel sides to each other, wherein the two parallel sides extend beyond the connecting support plate to form a U-shaped portion dimensioned to receive at least an end portion of a railroad tie therein, and the connecting support plate extends beyond an end surface of the end portion of the railroad tie received in the U-shaped portion.

2. The bracket as claimed in claim 1, further comprising:

a top connecting plate, perpendicular to the parallel sides, connected at a second portion of an upper edge of each of the parallel sides, wherein the connecting support plate is configured to support a switch on an upper surface thereof.

3. The bracket as claimed in claim 2, the parallel sides each having a tie extension portion and a support portion, the tie extension portion corresponding to the portion of the side extending beyond the connecting support plate, the support portion corresponding to at least the length of the side corresponding to the connection of the connecting support plate, wherein the bracket further comprises a switch supported on the connecting support plate.

4. The bracket as claimed in claim 3, the support portion of each of the parallel sides having a height less than a height of the tie extension portion, the bracket extending away from a rail being supported by the received railroad tie, the support portion extending beyond and away from the end portion of the railroad tie received in the U-shaped portion.

5. The bracket as claimed in claim 3, the support portion of each of the parallel sides having a length greater than a length of the tie extension portion.

6. The bracket as claimed in claim 3, each of the parallel sides having at least one through-hole formed in each of the tie extension portion and the support portion.

7. The bracket as claimed in claim 3, further comprising an isolation pad on the upper surface of the connecting support plate and configured to isolate the switch to be supported by the connecting support plate.

8. The bracket as claimed in claim 3, further comprising an isolation pad between the connecting support plate and the switch.

9. The bracket as claimed in claim 2, each of the parallel sides having at least two through-holes formed in the tie extension portion.

10. The bracket as claimed in claim 2, the top connecting plate positioned such that an inner surface of the top connecting plate faces an upper surface of the received end portion of the railroad tie.

11. The bracket as claimed in claim 1, further comprising:

a rear connecting plate, perpendicular to the parallel sides, connected at an end edge of each of the parallel sides.

12. The bracket as claimed in claim 11, the rear connecting plate being perpendicular to the connecting support plate.

13. The bracket as claimed in claim 12, the rear connecting plate positioned such that the surface of the rear connecting plate faces the end surface of the received end portion of the railroad tie.

14. The bracket as claimed in claim 1, further comprising:

a bottom plate, parallel to the connecting support plate, connected at a lower edge of each of the parallel sides.

15. The bracket as claimed in claim 1, wherein each of the parallel sides comprises at least one through-hole formed therein and for mounting the bracket to the railroad tie therein.

16. The bracket as claimed in claim 15, wherein the at least one through-hole formed in each of the parallel sides is aligned with the other at least one through-hole formed in the other parallel side.

17. The bracket as claimed in claim 15, wherein the at least one through-hole is two or more through-holes formed therein.

18. The bracket as claimed in claim 15, further comprising:

at least one anchor rod sized to span the formed U-shaped portion.

19. The bracket as claimed in claim 18, wherein the anchor rod is arranged to extend beyond the side of the parallel sides when inserted in each of the at least one through-holes and spanning the formed U-shaped portion.

20. The bracket as claimed in claim 1, the connecting support plate having at least one through-hole formed therein for connecting another object to the tie extension bracket.

21. The bracket as claimed in claim 1, further comprising an end plate, perpendicular to the parallel sides, connected at the edge of the support portion adjacent the tie extension portion.

22. A tie extension bracket comprising:

a pair of parallel sides;

a support surface, perpendicular to the parallel sides, and connected at a first portion of the upper edge of each of the parallel sides, the parallel sides extending beyond the connection with the support surface to form a U-shaped portion arranged to receive an end portion of a railroad tie therein; and a top connecting plate, perpendicular to the parallel sides, connected at a second portion of the upper edge of each of the parallel sides, wherein the support surface extends beyond an end surface of the end portion of the railroad tie received in the U-shaped portion and the top connecting plate having a length shorter than a length of the U-shaped portion.

23. The bracket as claimed in claim 22, each of the parallel sides having a tie extension portion corresponding to the portion of the side extending beyond the connection with the support surface, the support portion corresponding to a portion of the length of the side corresponding to the connection of the support surface, the height of the tie extension portion being greater than the height of the support portion, wherein the bracket further comprises an end plate, perpendicular to the parallel sides, connected at the edge of the support portion adjacent the tie extension portion.

24. A tie extension bracket configuration, the configuration comprising:

first and second tie extension brackets spaced apart from each other, each tie extension bracket having a tie extension portion and a support portion, the tie extension portion configured to receive a portion of a railroad tie at least partially into an interior thereof, the support portion having a connecting support plate connecting two parallel sides of the tie extension bracket to each other; and a switch spanning the first and second tie extension brackets and supported on the connecting support plate of each of the first and second tie extension brackets, wherein the support portion is configured to extend beyond an end surface of an end portion of a railroad tie received within the tie extension portion.

25. The tie extension bracket configuration as claimed in claim 24, wherein the first and second tie extension brackets are spaced apart from each other in a direction perpendicular to at least one of the received railroad ties.

* * * * *